US011767092B2

(12) United States Patent
Broughton

(10) Patent No.: US 11,767,092 B2
(45) Date of Patent: Sep. 26, 2023

(54) MARINE OUTBOARD ENGINE WITH A BUMPER FOR ABUTTING THE HATCH

(71) Applicant: BRP US INC., Sturtevant, WI (US)

(72) Inventor: George Broughton, Wadsworth, IL (US)

(73) Assignee: BRP US INC.

( * ) Notice: Subject to any disclaimer, the term of this patent is extended or adjusted under 35 U.S.C. 154(b) by 0 days.

(21) Appl. No.: 17/960,385

(22) Filed: Oct. 5, 2022

(65) Prior Publication Data

US 2023/0025883 A1 Jan. 26, 2023

Related U.S. Application Data

(62) Division of application No. 16/887,423, filed on May 29, 2020, now Pat. No. 11,492,088.

(60) Provisional application No. 62/855,460, filed on May 31, 2019.

(51) Int. Cl.
*B63H 20/04* (2006.01)
*B63B 17/00* (2006.01)

(52) U.S. Cl.
CPC ..... *B63H 20/04* (2013.01); *B63B 17/0081* (2013.01)

(58) Field of Classification Search
CPC ..... B63B 17/00; B63B 17/081; B63B 19/00; B63B 19/12; B63H 20/04
USPC ..... 440/52; 114/201 R
See application file for complete search history.

(56) References Cited

U.S. PATENT DOCUMENTS

| | | | | |
|---|---|---|---|---|
| 2,207,372 | A | 7/1940 | Clarke | |
| 2,216,496 | A | 10/1940 | MacKay | |
| 3,164,122 | A | 1/1965 | Fageol | |
| 3,269,351 | A | 8/1966 | Shimanckas | |
| 3,452,704 | A | 7/1969 | Watkins | |
| 3,911,853 | A | 10/1975 | Strang | |
| 4,178,873 | A | 12/1979 | Bankstahl | |
| 4,354,847 | A | 10/1982 | Blanchard | |
| 4,504,237 | A | 3/1985 | Blanchard | |
| 4,559,018 | A | 12/1985 | Nakahama et al. | |
| 4,666,410 | A | 5/1987 | Anselm | |
| 4,726,799 | A | 2/1988 | Harada et al. | |
| 4,773,215 | A | 9/1988 | Winberg et al. | |
| 5,052,320 | A * | 10/1991 | Cremer | B63H 20/12 114/146 |
| 5,176,551 | A | 1/1993 | Blanchard et al. | |
| 5,344,350 | A | 9/1994 | Hatch | |
| 5,472,361 | A | 12/1995 | Fujimoto et al. | |
| 5,562,511 | A | 10/1996 | Blanchard et al. | |
| 5,996,734 | A | 12/1999 | Lam et al. | |

(Continued)

*Primary Examiner* — Daniel V Venne
(74) *Attorney, Agent, or Firm* — BCF LLP

(57) ABSTRACT

A marine outboard engine including an engine unit; a drive unit operatively connected to the engine unit; an engine unit housing for supporting and covering the engine unit, the engine unit housing having a top surface; and one or more bumpers connected to the engine unit housing. The bumper projects above the top surface of the engine unit housing; or rearward of an upper rear end of the engine unit housing; or both above the top surface of the engine unit housing and rearward of an upper rear end of the engine unit housing. When the marine outboard engine is located under a boat hatch is in a closed position and the marine outboard engine is pivoted in at least one portion of a tilt range, the bumper is adapted for abutting a bottom surface of the hatch.

14 Claims, 19 Drawing Sheets

(56) References Cited

U.S. PATENT DOCUMENTS

| | | | | |
|---|---|---|---|---|
| 5,997,371 | A | 12/1999 | Oishi | |
| 6,082,343 | A | 7/2000 | Oishi et al. | |
| 6,346,018 | B1 | 2/2002 | Watanabe | |
| 6,516,768 | B1 | 2/2003 | Watanabe | |
| 6,626,154 | B1 | 9/2003 | Kanno | |
| 7,510,451 | B2 | 3/2009 | Inaba | |
| D714,345 | S | 9/2014 | Petit et al. | |
| 8,826,845 | B2 | 9/2014 | Mochizuki et al. | |
| 8,858,282 | B2 | 10/2014 | Lonnborg et al. | |
| 9,051,041 | B2 | 6/2015 | Litjens et al. | |
| 9,126,664 | B1 | 9/2015 | Denson et al. | |
| 9,216,795 | B2 | 12/2015 | McGill | |
| 9,254,904 | B2 | 2/2016 | Minoura | |
| 9,296,456 | B2 | 3/2016 | Mochizuki et al. | |
| 9,664,100 | B2 | 5/2017 | Shomura et al. | |
| 10,710,692 | B1 * | 7/2020 | Wittich | B63H 20/36 |
| 10,850,820 | B1 | 12/2020 | Minogue | |
| 10,927,745 | B1 | 2/2021 | Langenfeld | |
| 10,981,636 | B1 | 4/2021 | Langenfeld et al. | |
| 2002/0108587 | A1 | 8/2002 | Nagashima | |
| 2004/0107925 | A1 | 6/2004 | Katayama | |
| 2012/0115376 | A1 | 5/2012 | Daikoku et al. | |
| 2013/0280970 | A1 | 10/2013 | Clarkson et al. | |

* cited by examiner

MARINE OUTBOARD ENGINE WITH A BUMPER FOR ABUTTING THE HATCH

CROSS-REFERENCE TO RELATED APPLICATION

The present application is a divisional application of U.S. patent application Ser. No. 16/887,423, entitled "Boat Having a Hatch and a Marine Outboard Engine with a Bumper for Abutting the Hatch," filed on May 29, 2020, which claims priority to U.S. Provisional Patent Application Ser. No. 62/855,460, filed May 31, 2019, entitled "Marine Outboard Engine with a Bumper and Boat Provided with such a Marine Outboard Engine", the entirety of both of which is incorporated by reference herein.

TECHNICAL FIELD

The present technology relates to a marine outboard engine with a bumper for abutting the hatch and to a marine outboard engine with a bumper.

BACKGROUND

Some boats have a marine outboard engine mounted to a transom of the boat via a transom engine bracket assembly. Some boats also have a rear platform extending across the transom. In the present context, the rear platform is understood to be a platform structured to support the weight of one or more occupants, and can be used, for example, for entering and exiting the water from the rear of the boat and for on-water activities such as fishing.

Having the marine outboard engine mounted to the transom engine bracket assembly takes valuable space at the rear of the boat, and generally limits the size of the rear platform to a relatively small usable space. To address this issue, the rear platform of some boats extends to the sides and/or above the marine outboard engine of the boat. In such configurations, the rear platform is either discontinuous across the transom, i.e. the rear platform extends laterally on the left and right sides of the marine outboard engine, or the rear platform extends on different levels across the transom, which in the end provides limited usable space for occupants.

Moreover, in configurations where the rear platform extends above the marine outboard engine, the rear platform may limit the access to the marine outboard engine from above, which is the case when a user desires accessing the marine outboard engine from the rear platform, for example.

Thus, there is a desire for at least one of a marine outboard engine, a boat, and a boat having or adapted to receive a marine outboard engine that could mitigate at least some of the above-mentioned inconveniences.

SUMMARY

It is an object of the present technology to ameliorate at least some of the inconveniences present in the prior art.

According to an aspect of the present technology, there is provided a boat having a rear platform including a pivotable hatch defining at least partially the rear platform. The hatch has a bottom surface. The boat is free of an enclosed engine compartment, and the hatch defines thereunder a space for receiving a marine outboard engine. According to another aspect of the present technology, there is provided a marine outboard engine having at least one bumper connected to an engine unit housing.

When the marine outboard engine is mounted to the boat, the marine outboard engine fits entirely under the rear platform of the boat, and is positioned under the pivotable hatch. The at least one bumper is structured and dimensioned to abut the bottom surface of the pivotable hatch of the rear platform. When the marine outboard engine is pivoted about a tilt-trim axis in at least a portion of a tilt range, the at least one bumper abuts and slide along the bottom surface of the hatch, and pivots the hatch from a closed position to an open position.

Having the at least one bumper connected to the engine unit housing protects the top surface of the engine unit housing when the marine outboard engine abuts the bottom surface of the hatch and pivots the hatch between the closed and open positions. In addition, since the marine outboard engine is disposed under the rear platform, the pivotable hatch provides access to the marine outboard engine from above, which is the case when a user desires accessing the marine outboard engine from the rear platform, for example. Moreover, having the marine outboard engine disposed under the rear platform allows the rear platform to extend across a majority of the beam of the boat, thereby increasing the space available on the rear platform for occupants of the boat.

According to one aspect of the present technology, there is provided a boat including a transom, a rear platform extending at least partially across the transom, the rear platform including a hatch defining at least partially the rear platform, the hatch having a bottom surface, and a hatch pivot for pivoting the hatch about a hatch pivot axis from a first hatch position to a second hatch position. The boat further includes an engine transom bracket assembly connected to the transom and being located under the rear platform, the engine transom bracket assembly defining a tilt-trim axis, and a marine outboard engine mounted to the engine transom bracket assembly. The marine outboard engine includes an engine unit housing having a top surface and at least one bumper connected to the engine unit housing, the at least one bumper abutting the bottom surface of the hatch when the marine outboard engine is pivoted about the tilt-trim axis within at least one portion of a tilt range. When the hatch is in the first hatch position and when the marine outboard engine is in a first engine position in the at least one portion of the tilt range, the at least one bumper abuts the bottom surface of the hatch. When the marine outboard engine pivots about the tilt-trim axis from the first engine position to a second engine position in the at least one portion of the tilt range, the at least one bumper abuts and slides along the bottom surface of the hatch thereby pivoting the hatch about the hatch pivot axis from the first hatch position to the second hatch position.

In some implementations, the boat has a beam, and the rear platform extends across a majority of the beam of the boat.

In some implementations, the hatch pivot axis extends above and forward the tilt-trim axis of the engine transom bracket assembly.

In some implementations, the hatch is further pivotable about the hatch pivot axis from the second hatch position to a third hatch position, the second hatch position is between the first and third hatch positions, and in the third hatch position, the bottom surface of the hatch is spaced from the at least one bumper.

In some implementations, the hatch is manually pivotable from the second hatch position to the third hatch position.

In some implementations, the hatch has a width sufficient to accommodate a steering range of the marine outboard engine.

In some implementations, the at least one bumper projects above the top surface of the engine unit housing, or rearward of an upper rear end of the engine unit housing, or both above the top surface of the engine unit housing and rearward of an upper rear end of the engine unit housing.

In accordance with another aspect of the present technology, there is provided a marine outboard engine including an engine unit, a drive unit operatively connected to the engine unit, an engine unit housing for supporting and covering the engine unit, the engine unit housing having a top surface, and at least one bumper connected to the engine unit housing. The at least one bumper projects above the top surface of the engine unit housing, rearward of an upper rear end of the engine unit housing, or both above the top surface of the engine unit housing and rearward of an upper rear end of the engine unit housing.

In some implementations, when the marine outboard engine is located under a hatch of a boat being in a closed position, and the marine outboard engine is pivoted in at least one portion of a tilt range, the at least one bumper is adapted for abutting a bottom surface of the hatch.

In some implementations, the at least one bumper projects rearward of the upper rear end of the engine unit housing.

In some implementations, the at least one bumper projects above the top surface of the engine unit housing.

In some implementations, the top surface of the engine unit housing is formed from a first material and the at least one bumper is made of a second material that is different from the first material.

In some implementations, the second material is more resistant to wear than the first material.

In some implementations, the at least one bumper extends across the top surface of the engine unit housing from a front end to a rear end of the top surface.

In some implementations, the marine outboard engine further includes at least one channel defined in the top surface of the engine unit housing. The at least one bumper is received at least in part within the at least one channel.

In some implementations, the at least one bumper includes a first bumper and a second bumper.

In some implementations, the engine unit includes an engine block and the drive unit includes a gear case, and the engine block is disposed above the gear case and in proximity to the gear case.

In accordance with yet another aspect of the present technology, there is provided a method of opening a hatch of a rear platform of a boat from a closed position to an open position, the hatch defining at least partially the rear platform when in the closed position, the boat having a marine outboard engine located under the hatch and being pivotable from a trim range to a tilt range. The method includes, with the hatch in the closed position and the marine outboard engine in the tilt range, pivoting the marine outboard engine upwardly to a first engine position where at least one bumper provided on the marine outboard engine abuts a bottom surface of the hatch, and pivoting the marine outboard engine upwardly from the first engine position to a second engine position, the pivoting of the marine outboard engine from the first engine position to the second engine position causing the at least one bumper to push up on the bottom surface of the hatch and to slide against the bottom surface of the hatch, thereby pivoting the hatch from the closed position to the open position.

In some implementations, the open position is an intermediate open position, the method further includes pivoting the hatch from the intermediate open position to a fully open position, the intermediate open position being between the closed position and the fully open position, and the bottom surface of the hatch being spaced from the at least one bumper when in the fully open position.

In some implementations, the method further includes locking the hatch pivoted in the fully open position using a lock.

According to yet another aspect of the present technology, there is provided a boat having a transom and a rear platform extending at least partially across the transom. The rear platform includes a hatch defining at least partially the rear platform, the hatch having a bottom surface, and a hatch pivot for pivoting the hatch about a hatch pivot axis from a first hatch position to a second hatch position. The boat is free of an enclosed engine compartment. The hatch at least partially defines thereunder a space for receiving a marine outboard engine. The space extends rearwardly of the transom and is open at a rear of the boat.

In some implementations, the boat has a beam, and the rear platform extends across a majority of the beam of the boat.

In some implementations, the hatch has a front portion, and the hatch pivot is located in the front portion of the hatch.

In some implementations, the rear platform has a front portion and a rear portion, and the hatch is pivotally connected to the front portion of the rear platform.

In some implementations, when the hatch is in the first hatch position, the hatch extends to a rear end of the rear platform.

In some implementations, the hatch is further pivotable about the hatch pivot axis from the second hatch position to a third hatch position. The second hatch position is between the first and third hatch positions.

In some implementations, the second hatch position and the third hatch position of the hatch are on opposite sides of a vertical plane containing the hatch pivot axis.

In some implementations, the boat further includes a lock for maintaining the hatch in the third hatch position.

In some implementations, the rear platform and the hatch are structured to support at least 225 pounds.

For the purposes of this application, terms related to spatial orientation such as forward, rearward, left, right, vertical, and horizontal are as they would normally be understood by a driver of a boat sitting thereon in a normal driving position with a marine outboard engine mounted to a transom of the boat.

Implementations of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Should there be any discrepancies in the definitions of terms in this application and the definition of these terms in any document included herein by reference, the terms as defined in the present application take precedence.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
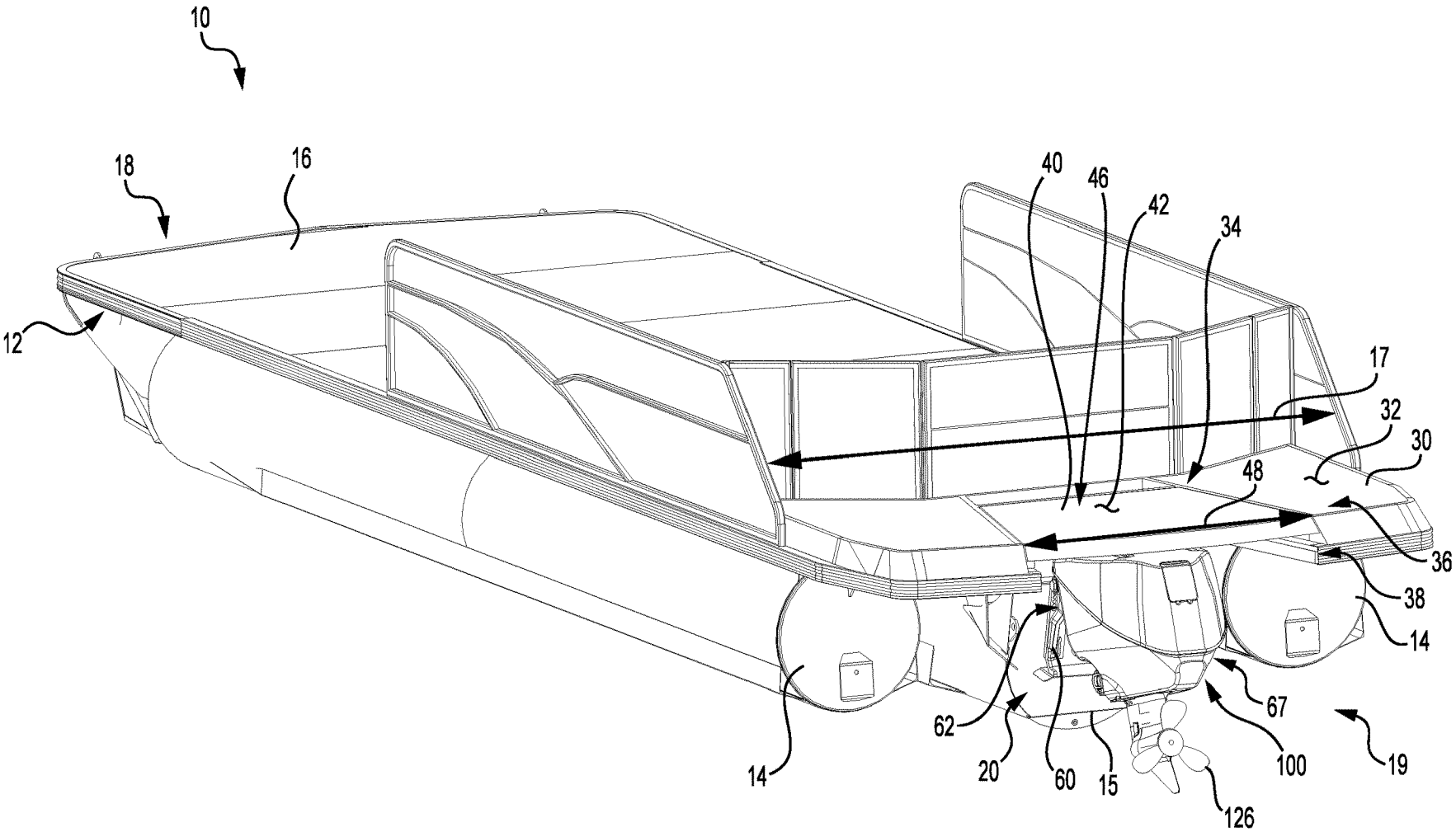
FIG. 1 is a perspective view taken from a rear, top, left side of a boat according to the present technology with a marine outboard engine pivoted about a tilt-trim pivot axis in a trimmed position, and with a hatch of a rear platform pivoted in a closed position.
Figure 2:
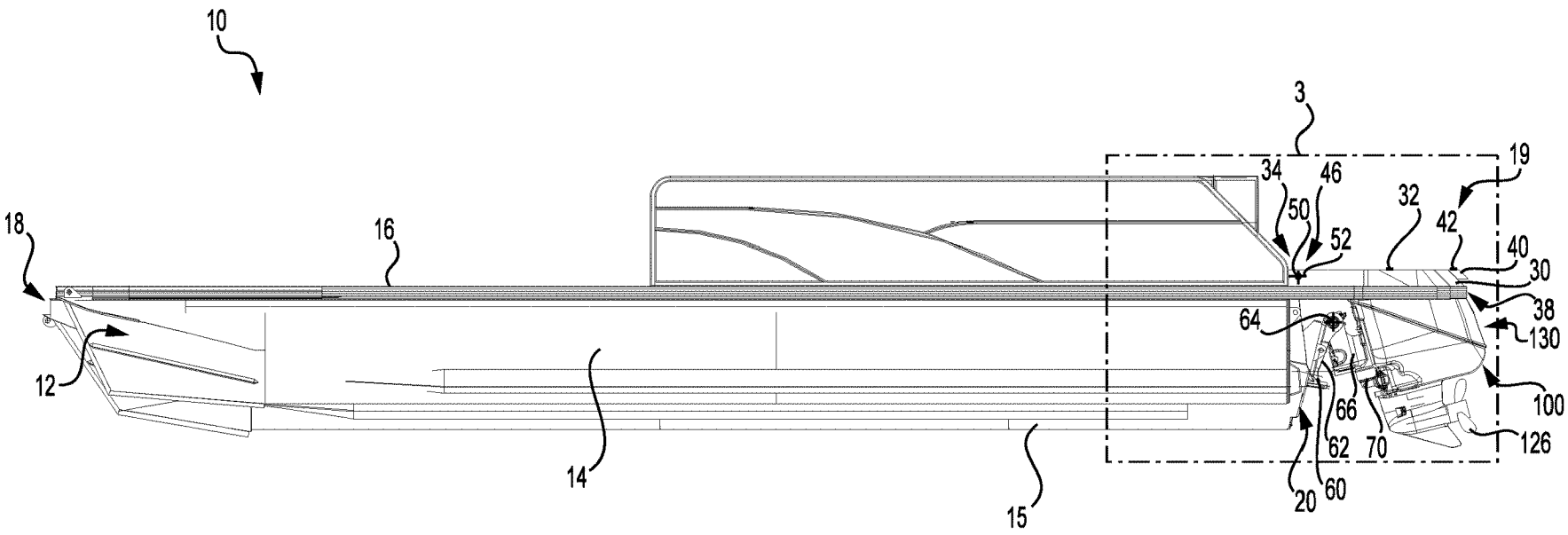
FIG. 2 is a left side elevation view of the boat of FIG. 1.
Figure 3:
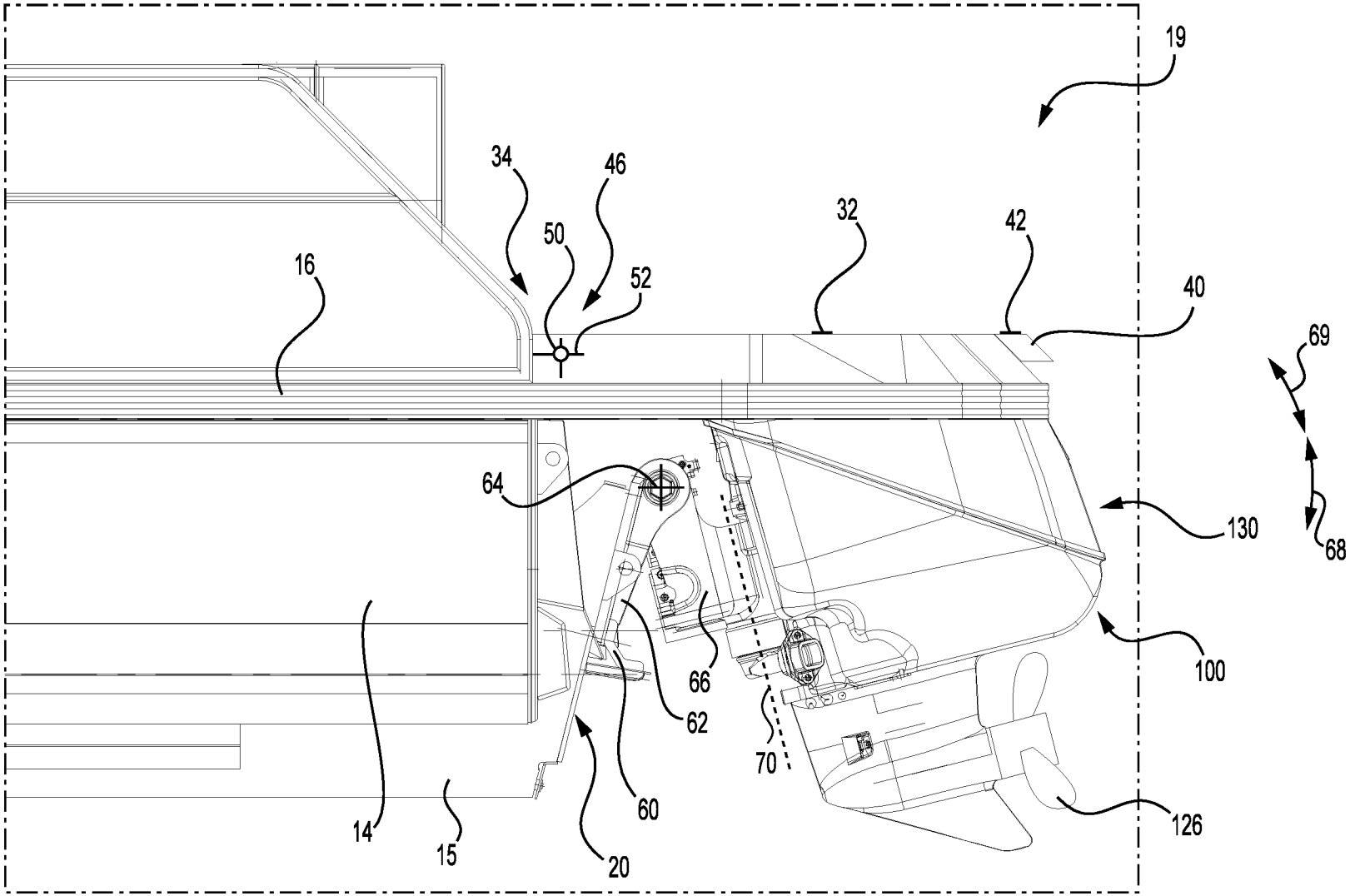
FIG. 3 is a close-up view of portion 3 of FIG. 2.

Referring to FIGS. 1 to 3, a boat 10 and a marine outboard engine 100 according to implementations of the present technology are illustrated. The boat 10 is specifically a pontoon boat 10, but this is simply one non-limiting example of a boat according to the present technology. This particular implementation of the boat 10 includes a watercraft body 12 formed generally from two side pontoons 14, a central pontoon 15 and a deck 16. The watercraft body 12 has a beam 17. The watercraft body 12 defines the bow 18 and the stern 19 of the boat 10. The boat 10 is free of an enclosed engine compartment. The engine 100 providing propulsion to the boat 10 on the water is the marine outboard engine 100.

The boat 10 has a transom 20 defined by the central pontoon 15. The transom 20 extends laterally between the side pontoons 14, and vertically generally below the deck 16. In other implementations where the watercraft body 12 includes a hull, the transom 20 is defined by a rear wall of the hull. The transom 20 could differ in shape and size in different implementations of the present technology.

The boat 10 also includes a rear platform 30 that extends across the transom 20. More particularly, in the present implementation, the rear platform 30 extends across the entire beam 17 of the boat 10. The rear platform 30 could extend otherwise in other implementations. For example, the rear platform 30 could extend across a majority of the beam 17 of the boat 10, but not across the entirety thereof. The rear platform 30 could also extend only partially across the beam 17 of the boat 10.

The rear platform 30 is structured to support the weight of one or more occupants. The rear platform 30 can be used, for example, to enter the water and reboard the boat 10 from the stern 19 of the boat 10. In the present implementation, the rear platform 30 is structured to support at least 225 pounds, which corresponds to the weight of the ninety-fifth percentile North American adult male as defined by the Anthropomorphic Reference Data for Formula SAE, available online at https://www.fsaeonline.com/content/FSAE%20Rules95th_2016.pdf, the entirety of which is incorporated herein by reference. In some implementations, it is contemplated that the rear platform 30 could support at least 900 pounds, which corresponds to the weight of four ninety-fifth percentile North American adult males. It is contemplated that the rear platform 30 could be structured to support the weight of the maximum number of occupants of the boat 10. It is contemplated that the hatch 40 could be constructed of a transparent material, thereby enabling the operator(s) to see the marine outboard engine 100 therebelow.

Figure 5:
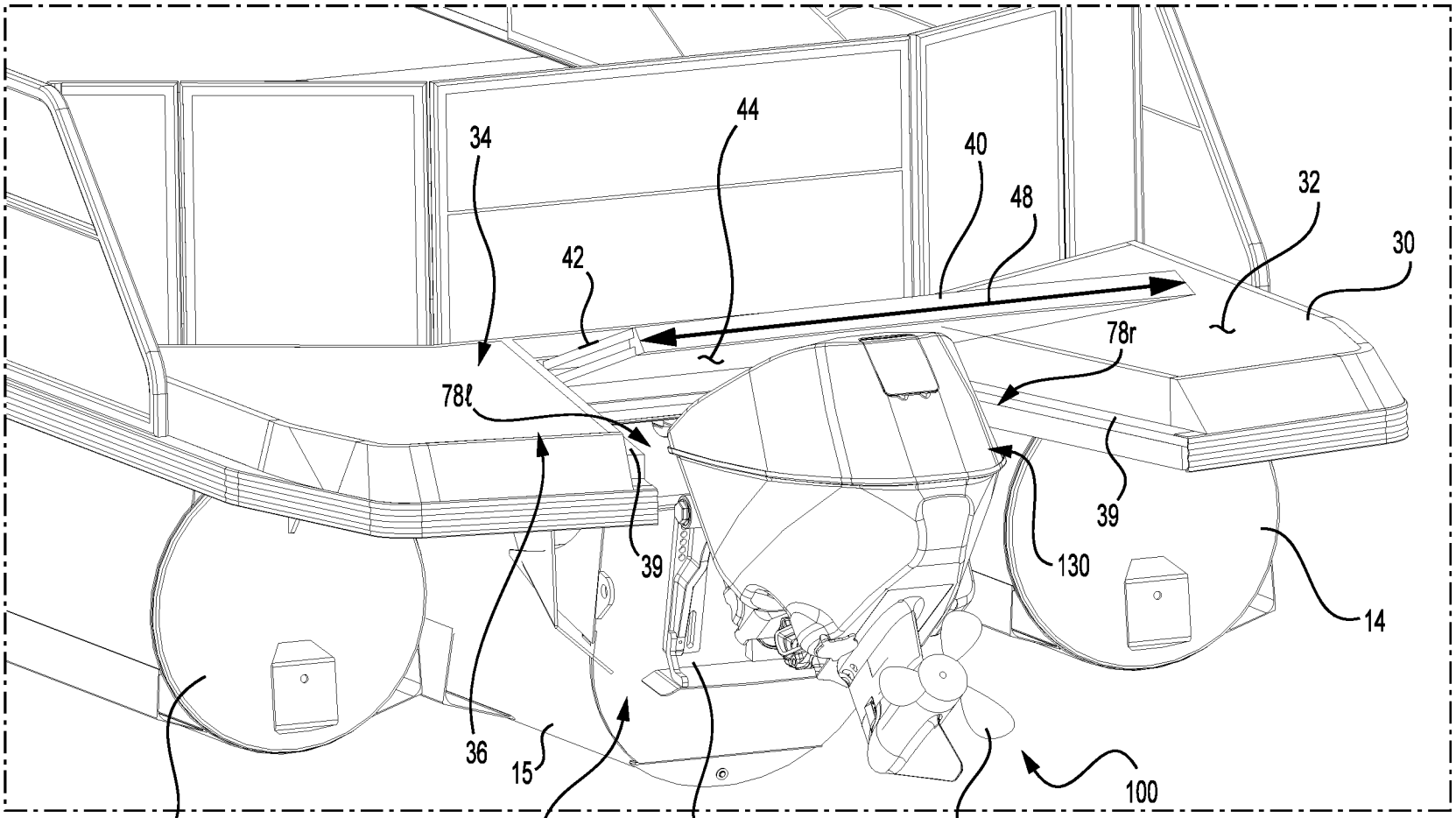
FIG. 5 is a close-up view of portion 5 of FIG. 4.

The rear platform 30 has a top surface 32. In some implementations, the top surface 32 is texturized to provide grip to an occupant standing thereon, and/or is provided with a padding material extending on a portion or the entirety of the top surface 32. The padding material may provide more comfort and traction to an occupant boarding the boat 10 from the water and/or to an occupant lying down on the rear platform 30. The rear platform 30 has a front portion 34 and a rear portion 36 defined consistently with the bow 18 and the stern 19 of the boat 10. The rear portion 36 defines a rear end 38 of the rear platform 30. The rear platform 30 also has lip portions 39 (FIG. 5). The lip portions 39 project laterally towards a center of the rear platform 30.

Referring to FIGS. 1 to 3, it is also to be noted that the rear platform 30 is vertically offset from the deck 16 in that the top surface 32 of the rear platform 30 extends above the deck 16. In other implementations, it is contemplated that the top surface 32 of the rear platform 30 and the deck 16 could be on a same level or that the top surface 32 could be below the deck 16.

Still referring to FIGS. 1 to 3, the rear platform 30 includes a hatch 40. The hatch 40 defines partially the rear platform 30. More particularly, the hatch 40 defines a central portion of the rear platform 30 in the present implementation. The hatch 40 is also structured to support at least 225 pounds, which corresponds to the weight of the ninety-fifth percentile North American adult male, as described above. In some implementations, it is contemplated that the hatch 40 could support at least 900 pounds, which corresponds to the weight of four ninety-fifth percentile North American adult males. The hatch 40 could also be structured to support the weight of the maximum number of occupants of the boat 10.

The hatch 40 has a top surface 42 and a bottom surface 44. The bottom surface 44 is best seen in FIGS. 4 to 9. The hatch 40 further has a front portion 46 extending adjacent the front portion 34 of the rear platform 30. The hatch 40 also has a width 48. The position, size, and shape of the hatch 40 in the rear platform 30 could differ in other implementations. It is also contemplated that more than one hatch 40 could be provided in the rear platform 30.

Figure 6:
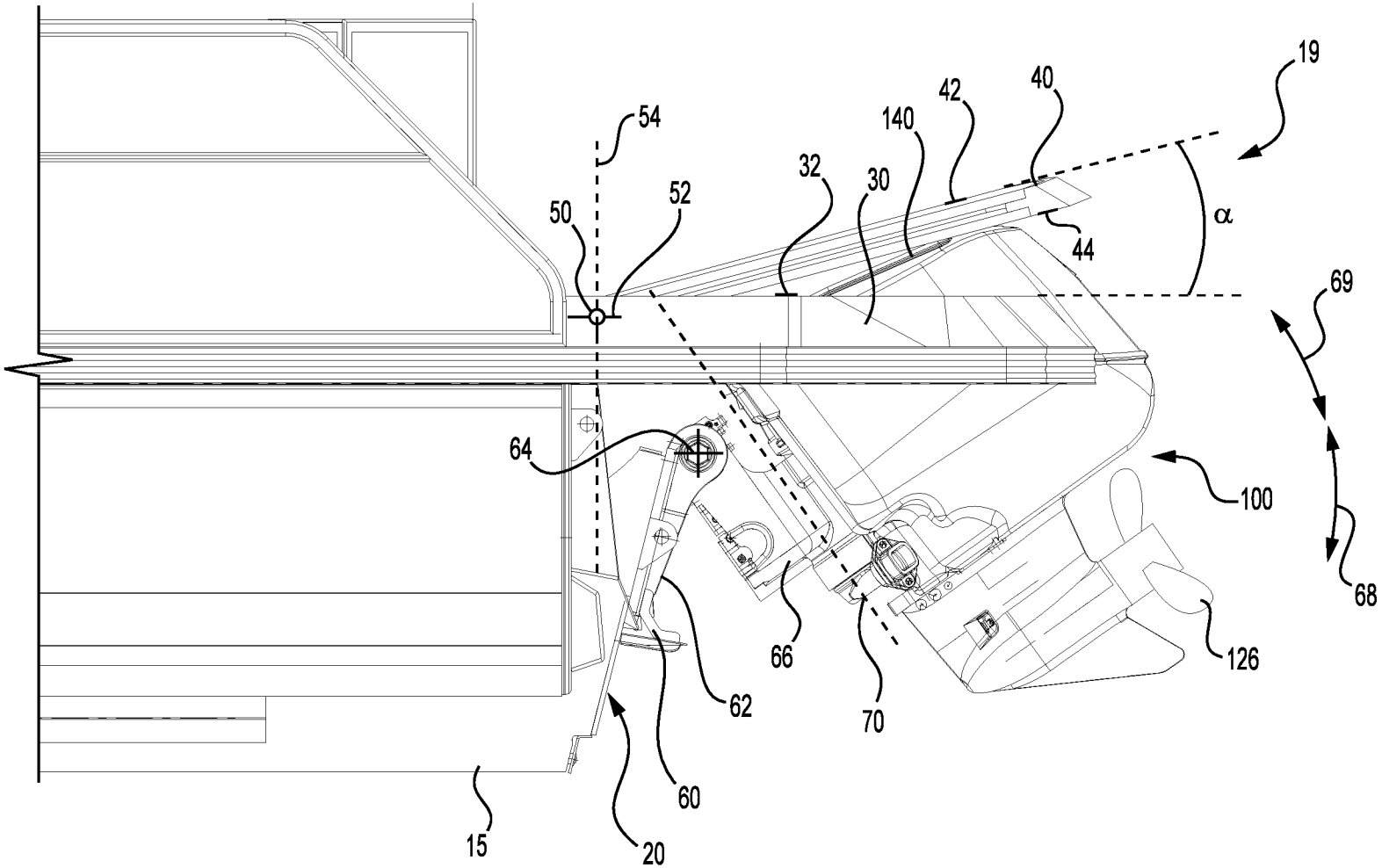
FIG. 6 is a close-up view of a rear left side of the boat of FIG. 4.
Figure 8:
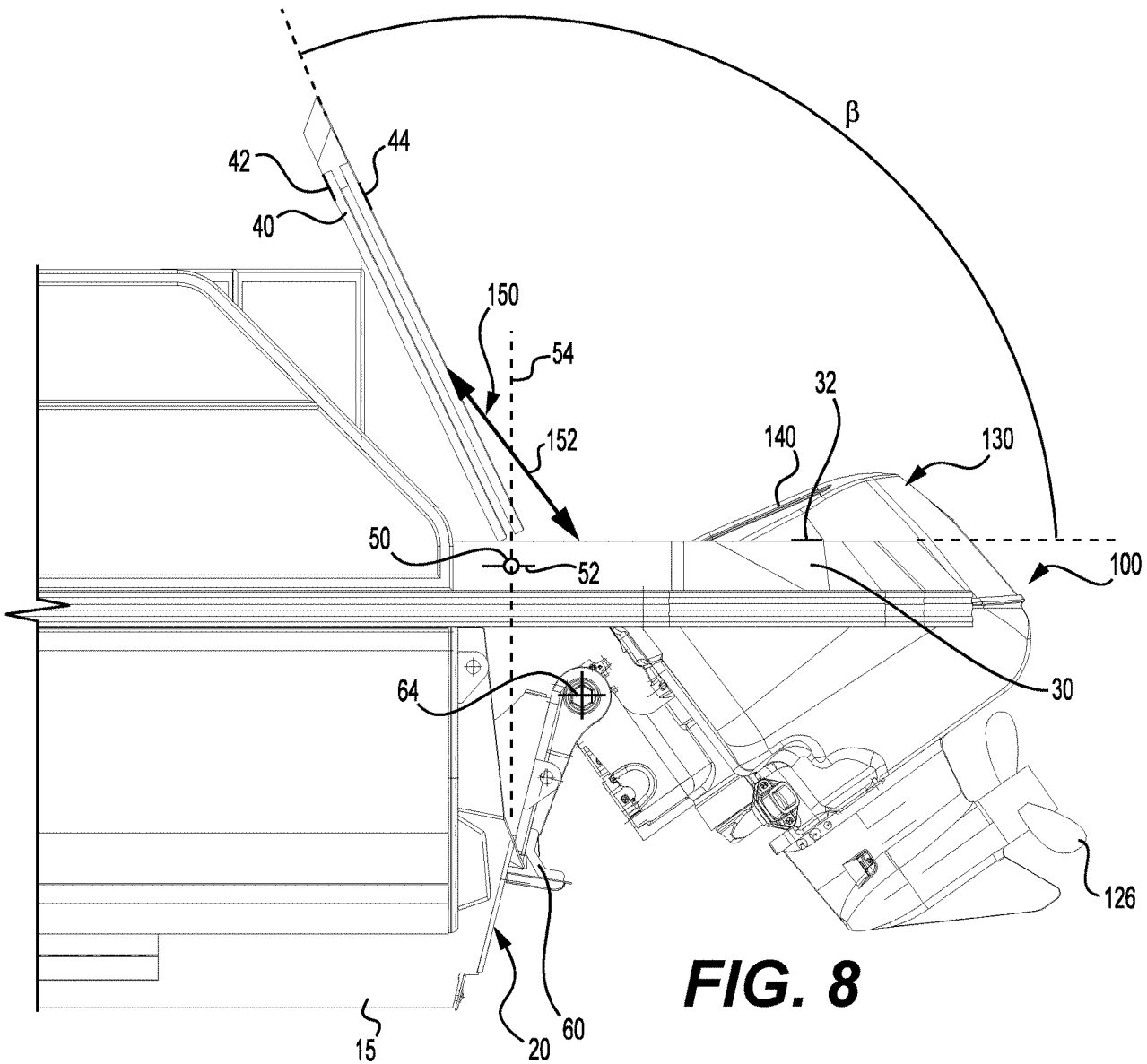
FIG. 8 is a close-up view of a rear left side of the boat of FIG. 7.

Referring to FIGS. 2, 6 and 8, the rear platform 30 further includes a hatch pivot 50. The hatch pivot 50 is located in the front portion 46 of the hatch 40 and adjacent the front portion 34 of the platform 30. The hatch pivot 50 allows the hatch 40 to pivot about a hatch pivot axis 52 in different positions. As such, the hatch 40 is pivotally connected to the front portion 34 of the rear platform 30. The hatch pivot axis 52 extends generally horizontally. The different positions in which the hatch 40 can be pivoted about the hatch pivot axis 52 are briefly described below.

In FIGS. 1 to 3, the hatch 40 is shown in the closed position. In the closed position, the top surface 42 of the hatch 40 is generally on the same level as the top surface 32 of the rear platform 30, and the bottom surface 44 abuts the lip portions 39 of the rear platform 30. When the hatch 40 is in the closed position, the rear platform 30 offers a continuous planar surface extending across the entire beam 17 of the boat 10. In other words, when the hatch 40 is in the closed position, the rear platform 30 provides a continuous planar surface on which an occupant can, for example, stand, reboard the boat 10 from the rear, and move about or lie down thereon. As best seen in FIG. 3, when in the closed position, the hatch 40 extends to the rear end 38 of the rear platform 30. It is to be noted that in other implementations, the top surface 42 of the hatch 40 and the top surface 32 of the rear platform 30 could extend on different levels when the hatch 40 is in the closed position.

Figure 4:
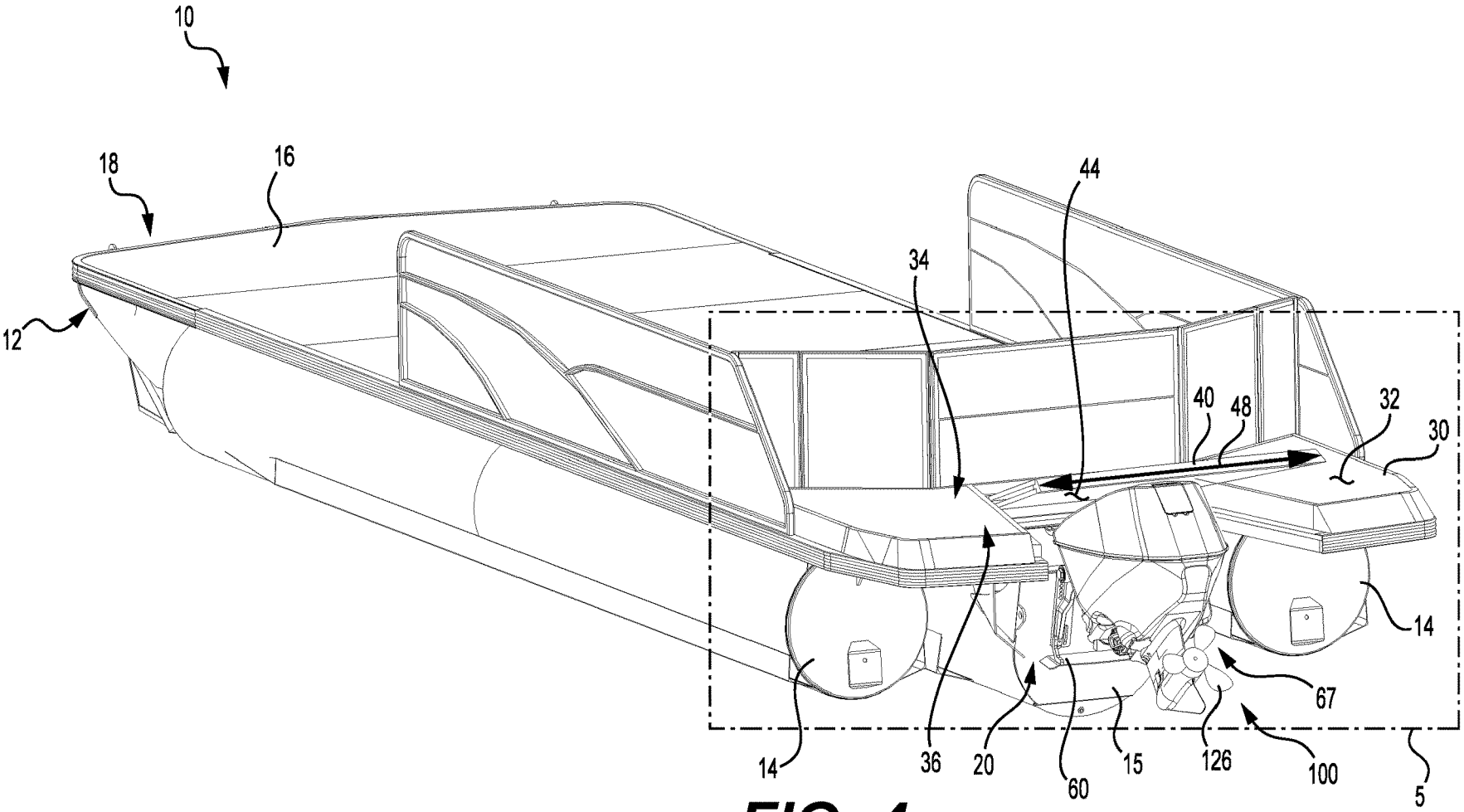
FIG. 4 is a perspective view taken from a rear, top, left side of the boat of FIG. 1, with the marine outboard engine pivoted about the tilt-trim axis in a fully tilted-up position and with the hatch pivoted in an intermediate open position.

In FIGS. 4 to 6, the hatch 40 is shown in an intermediate open position. In the intermediate open position, the top surface 42 of the hatch 40 is no longer generally on a same level with the top surface 32 of the rear platform 30 since the top surface 42 of the hatch 40 extends above the top surface 32 of the rear platform 30. The top surface 42 of the hatch 40 is also angled relative to the top surface 32 of the rear platform 30 due to the pivoting about the hatch pivot axis 52. In the intermediate open position, the top surface 42 and the top surface 32 are angularly spaced by an angle $\alpha$(FIG. 6).

Figure 7:
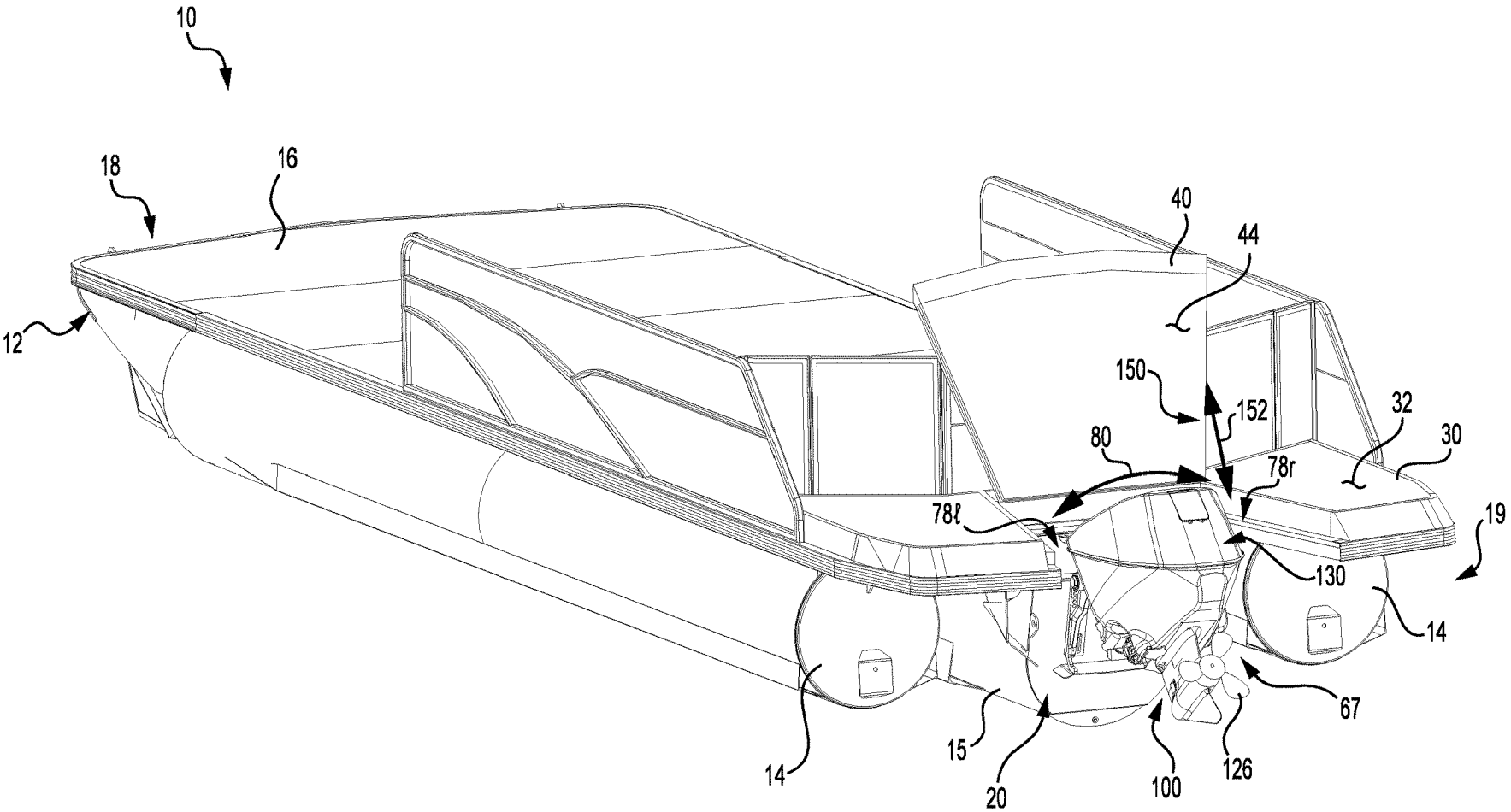
FIG. 7 is a perspective view taken from a rear, top, left side of the boat of FIG. 4, with the hatch pivoted in a fully open position.
Figure 9:
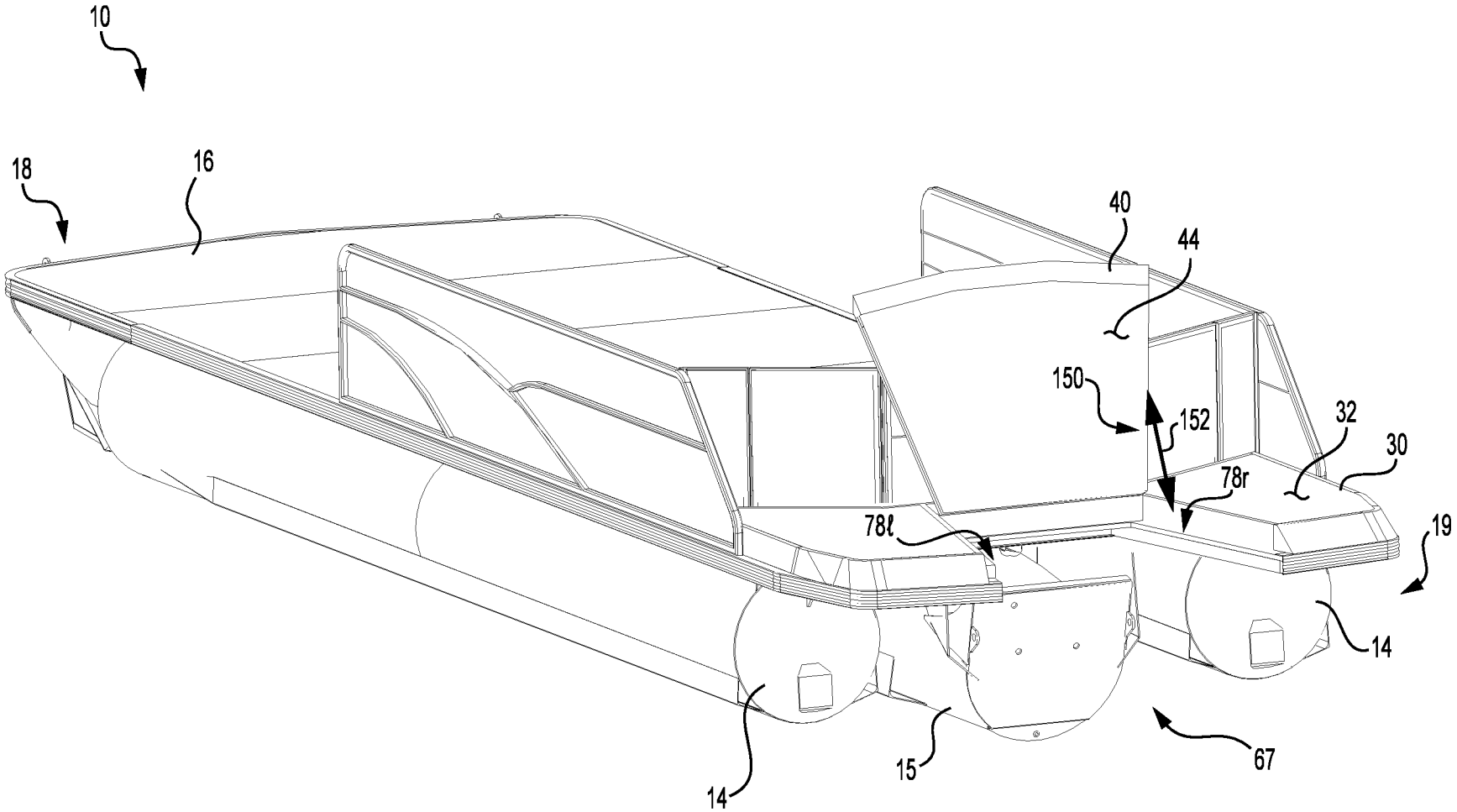
FIG. 9 is a perspective view taken from a rear, top, left side of the boat of FIG. 7, with the marine outboard engine and the engine transom bracket assembly removed.

In FIGS. 7 to 9, the hatch 40 is shown in a fully open position. In the fully open position, the top surface 42 of the hatch 40 also does not extend on the same level as the top surface 32 of the rear platform 30 and the top surface 42 is also angled relative to the top surface 32. In the fully open position, the top surface 42 and the top surface 32 are angularly spaced by an angle (3 (FIG. 8). The angle (3 is greater than the angle $\alpha$.

Referring to FIGS. 6 and 8, a vertical plane 54 containing the hatch pivot axis 52 is illustrated. When the hatch 40 is pivoted about the hatch pivot axis 52 in the intermediate open position (FIG. 6), the hatch 40 extends rearward of the plane 54. In contrast, when the hatch 40 is pivoted in the fully open position (FIG. 8), the hatch 40 extends forward of the plane 54.

More details regarding how the hatch 40 pivots between the closed position, the intermediate open position and the fully open position will be provided below.

Referring back to FIGS. 1 to 3, the boat 10 further includes an engine transom bracket assembly 60. The engine transom bracket assembly 60 has a stern bracket 62 which is adapted for fastening to the watercraft body 12, and more particularly to the transom 20 of the boat 10. The engine transom bracket assembly 60 further includes a swivel bracket 66 connected to the stern bracket 62. The swivel bracket 66 is pivotable with respect to the stern bracket 62 about a tilt-trim axis 64 defined by the engine transom bracket assembly 60. The tilt-trim axis 64 extends generally horizontally. The engine transom bracket assembly 60 is located under the hatch 40 of the rear platform 30.

Figure 10:
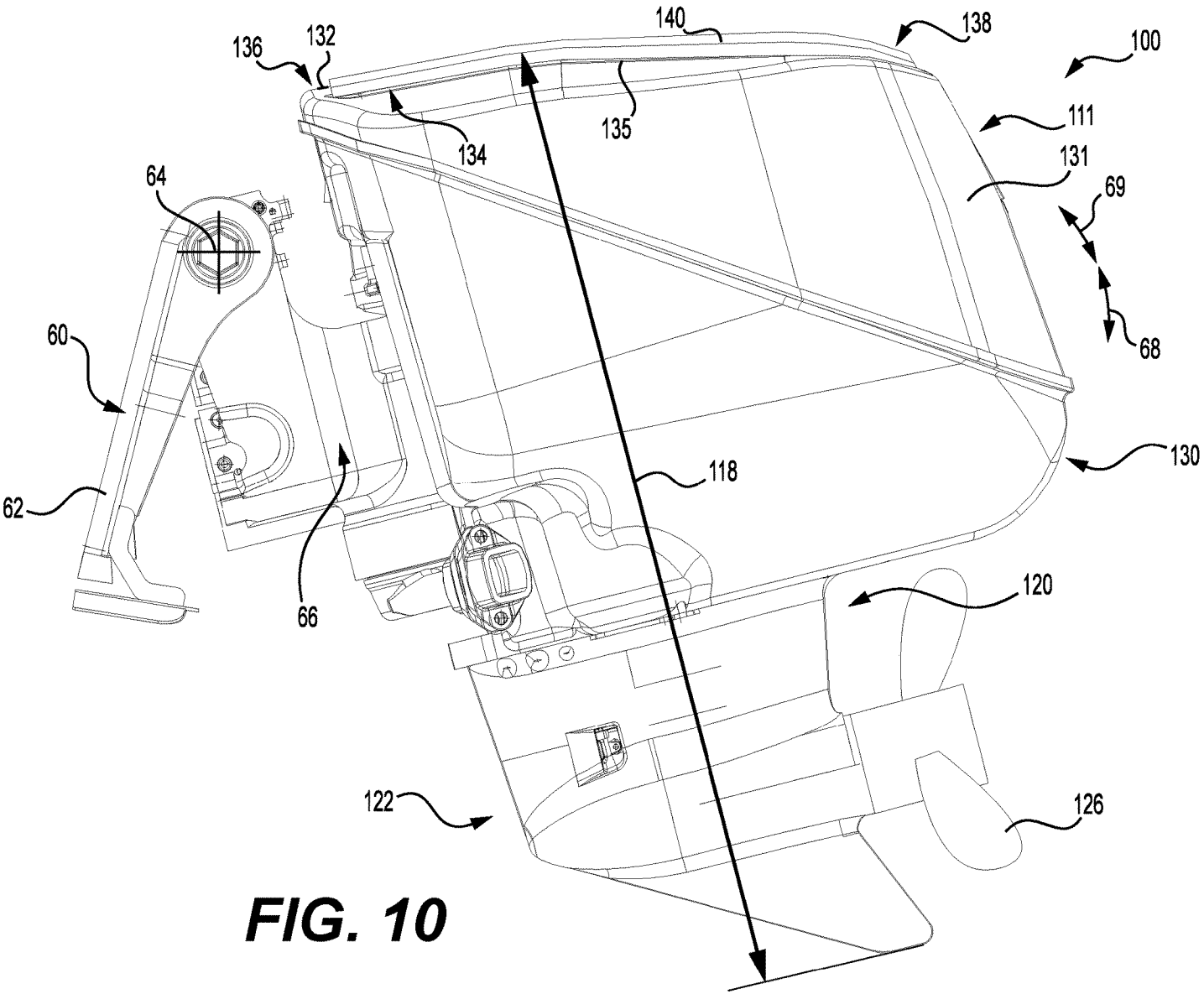
FIG. 10 is a left side elevation view of the marine outboard engine of FIG. 1, with the engine transom bracket assembly connected thereto.

Referring to FIGS. 8 and 10, the hatch pivot axis 52 extends forward and above the tilt-trim axis 64. It is contemplated that the hatch pivot axis 52 and the tilt-trim axis 64 could extend otherwise in other implementations. For example, it is contemplated that the hatch pivot axis 52 could extend longitudinally, i.e. perpendicular to the tilt-trim axis 64, along the left or right side of the hatch 40. In such an alternate implementation, the hatch 40 would open to the left or right, rather than forward as shown in the illustrated implementation. It is contemplated that two longitudinally pivoted hatches 40 could be provided, one on either side of the marine outboard engine 100.

It can be seen from FIGS. 1, 4, 7 and 9 that a space 67 extending under the hatch 40 and rearwardly of the engine transom bracket assembly 60 is open at the stern 19 of the boat 10. The space 67 is partially occupied by the marine outboard engine 100 when mounted to the boat 10 via the engine transom bracket assembly 60, as seen in FIGS. 1 to 8.

Referring to FIGS. 1 to 8, the marine outboard engine 100 is shown mounted to the boat 10, and is shown in more details in FIGS. 10 to 13. The marine outboard engine 100 is pivotably and rotatably connected to the watercraft body 12 via the engine transom bracket assembly 60 for providing propulsion to the boat 10 and to steer the boat 10. The marine outboard engine 100 can be trimmed or tilted upwardly or downwardly about the tilt-trim axis 64 in corresponding trim range 68 and tilt range 69 relative to the watercraft body 12. The trim range 68 and the tilt range 69 are schematically shown by bidirectional arrows in FIGS. 3, 6, 10 and 13. The engine transom bracket assembly 60 further defines a steering axis 70 (FIG. 13) about which the marine outboard engine 100 is pivoted left and right in order to steer the boat 10. In the illustrated implementation, the trim range 68 is from about −6 degrees to about +15 degrees and the tilt range 69 is from about +15 degrees to about +75 degrees (all with respect to a vertical axis).

Figure 13:
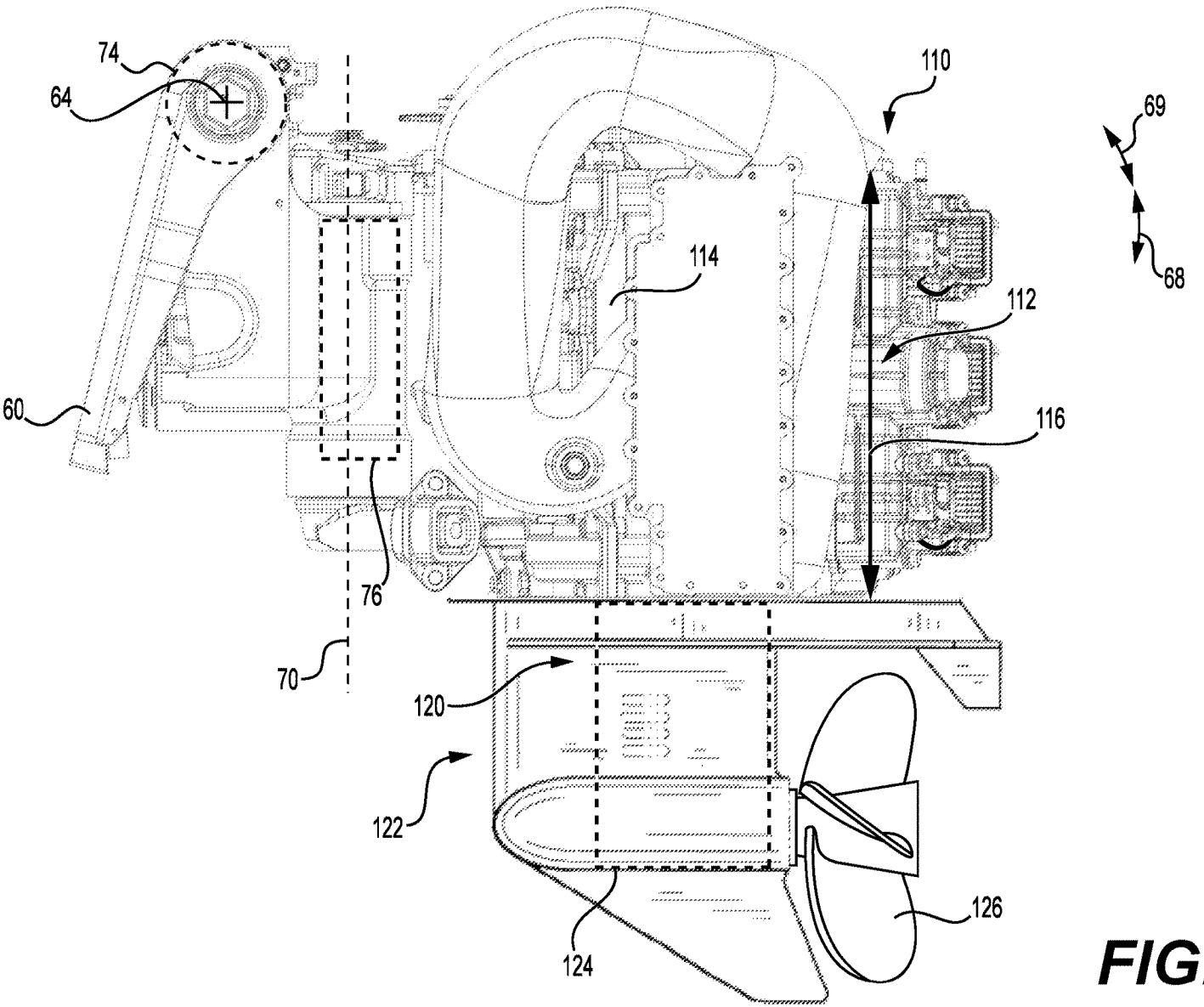
FIG. 13 is a left side elevation view of the marine outboard engine of FIG. 10, with an engine unit housing of the marine outboard engine removed.

Referring to FIG. 13, the marine outboard engine 100 can be trimmed-out or in and tilted-up or down about the tilt-trim axis 64 by a hydraulic rotary tilt-trim actuator 74 (schematically shown in FIG. 13). The marine outboard engine 100 can also be steered left or right about the steering axis 70 by a hydraulic rotary steering actuator 76 (schematically shown in FIG. 13). The steering axis 70 extends generally perpendicularly to the tilt-trim axis 64. When the marine outboard engine 100 is in the upright position as shown in FIG. 13, the steering axis 70 extends generally vertically. It is contemplated that other types of tilt-trim and steering actuators 74, 76 could be used.

Referring to FIGS. 7 and 9, left and right spaces **78*l*, 78*r* extend between the marine outboard engine 100 and the lip portions 39 of the rear platform 30. The size and shape of the spaces 78*l*, 78*r* are selected to provide sufficient clearance to allow the marine outboard engine 100 to be pivoted left and right about the steering axis 70 through a maximum steering range 80 of the marine outboard engine 100. The steering range 80 is schematically shown in FIG. 7 by the bidirectional arrow. The maximum steering range 80 of the marine outboard engine 100 about the steering axis 70 is from about −32 degrees to about +32 degrees. Other maximum steering ranges 80** are contemplated.

When the marine outboard engine 100 is fully steered to the left about the steering axis 70, the marine outboard engine 100 extends in the space 78*l* and does not contact the side of the left lip portion 39 of the rear platform 30, regardless of the tilt-trim angle of the marine outboard engine 100. Similarly, when the marine outboard engine 100 is fully steered to the right about the steering axis 70, the marine outboard engine 100 extends in the space 78*r* and does not contact the side of right lip portion 39 of the rear platform 30, regardless of the tilt-trim angle of the marine outboard engine 100. Since the hatch 40 spans over the left and right lip portions 39 and from the left space 78*l* to the right space 78*r*, the width 48 of the hatch 40 is sufficient to accommodate the steering range 80 of the marine outboard engine 100.

Figure 11:
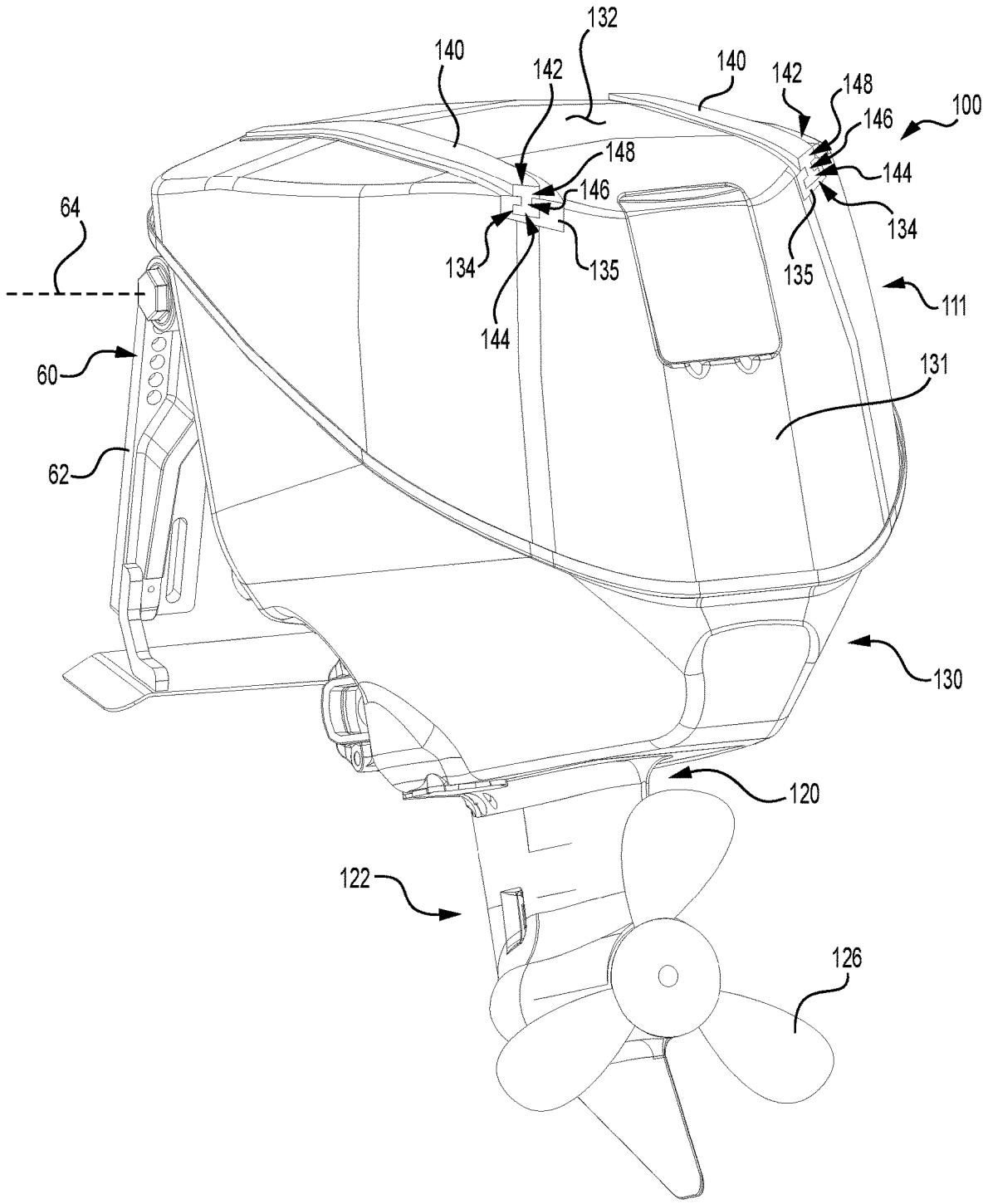
FIG. 11 is a perspective view taken from a rear, top, left side of the marine outboard engine and the engine transom bracket assembly of FIG. 10.

With reference to FIGS. 10 to 13, the marine outboard engine 100, shown in an intermediate trimmed position in FIGS. 10 and 11 and in a fully trimmed-in position in FIG. 13, will be described in more details.

The marine outboard engine 100 includes an engine unit 110 and a drive unit 120 operatively connected to the engine unit 110. The engine unit 110 is received in an upper portion 111 of the marine outboard engine. The drive unit 120 is enclosed in a lower portion 122 of the marine outboard engine 100. The drive unit 120 includes a gear case 124 (schematically shown in FIG. 13) which drives a propeller 126. The engine transom bracket assembly 60 supports the engine unit 110 on the transom 20 of the boat 10 such that the propeller 126 is in a submerged position when the marine outboard engine 60 is pivoted about the tilt-trim axis 64 in the trim range 68 and with the boat 10 resting relative to a surface of a body of water.

The engine unit 110 includes an internal combustion engine 112 surrounded and protected by an engine unit housing 130. The internal combustion engine 112 is disposed in the engine unit housing 130 for powering the marine outboard engine 100 and for driving the propeller 126 through the drive unit 120. In the present implementation, the internal combustion engine 112 is a three-cylinder, two-stroke, gasoline-powered, direct injected internal combustion engine. It is contemplated that the internal combustion engine 112 could be a four-stroke internal combustion engine. It is contemplated that the engine 112 could have more or less than three cylinders. In some implementations, the internal combustion engine 112 could use a fuel other than gasoline, such as diesel. It is also contemplated that the internal combustion engine 112 could be replaced by an electric motor. It should be noted that implementations where an electric motor is provided are encompassed by the terms "marine outboard engine" and "engine unit" of the present description.

The engine unit 110 includes an engine block 114. The engine block 114 has a height 116. The engine block 114 is disposed above the gear case 124 of the drive unit 120 and in proximity to the gear case 124. In the context of the present description, "in proximity" means that a vertical spacing between the engine block 114 and the gear case 124 is less than the height 116 of the engine block 114. As such and in contrast with several marine outboard engines, the marine outboard engine 100 has no central exhaust housing that is often referred to as the midsection. An overall height 118 (FIG. 10) of the marine outboard engine 100 is shorter compared to traditional marine outboard engines 100 having a midsection and a similar power output.

Still referring to FIGS. 10 to 13, the engine unit housing 130 is sealed such that fluids surrounding the engine unit 110 are impeded from entering the engine unit housing 130 during normal operating conditions, including when at rest, and components of the engine 112 inside the engine unit housing 130 are water-proofed to the same degree as in a conventional marine outboard engine. Depending on the specific implementation of the engine unit housing 130 and methods used to produce a generally water-tight seal, the engine unit housing 130 could be water-proof to varying degrees. It is contemplated that the engine unit housing 130 could receive different treatments to seal the housing 130 depending on the specific application for which the marine outboard engine 100 is going to be used. It is contemplated that the engine unit housing 130 could include a check valve or other waterproof pressure relief mechanism to equalize the pressure inside and outside the engine unit housing 130. Other known components of the engine unit 110 are included within the engine unit housing 130 such as a starter motor, an electrical generator and the exhaust system. As it is believed that these components would be readily recognized by one of ordinary skill in the art, further explanation and description of these components will not be provided herein. It is contemplated that the propulsion system of the marine outboard engine 100 could alternatively include a jet propulsion device, turbine or other known propelling device.

Referring to FIGS. 10 and 11, the engine unit housing 130 includes a cover 131 that covers the rear and upper portion of the engine 112. The cover 131 has a top surface 132. Left and right channels 134 are defined in the top surface 132 of the cover 131. The left and right channels 134 are defined by tracks 135 connected to the top surface 132 of the cover 130. The left and right channels 134 extend across the top surface 132 from a front end 136 of the top surface 132 to a rear end 138 of the top surface 132. In other implementations, the left and right channels 134 could be shorter that what is shown in the accompanying Figures. For example, the left and right channels 134 could extend across a portion of the top surface 132 between the front end 136 and the rear end 138 thereof, but not across the entirety of the top surface 132 of the cover 131.

Left and right bumpers 140 are received in the corresponding left and right channels 134. The left and right bumpers 140 are made of a material that differs from the material forming the top surface 132 of the cover 131 of the engine unit housing 130. In the present implementation, the material of the left and right bumpers 140 is more resistant to wear than the material forming the top surface 132 of the cover 131 of the engine unit housing 130. Resistance to wear can be quantified using the wear coefficient value K. K is defined for abrasive wear as a ratio corresponding to (i) a work done to create abrasive wear particles of a material having a hardness H by cutting a volume V of the material over (ii) an external work done for applying a normal load P to the material over a sliding distance L, K being equal to 3*HV/PL, as described in the article titled "*Wear Coefficient*" available online at https://en.wikipedia.org/w/index.php?title=Wear_coefficient&oldid=942198354, the entirety of which being incorporated herein by reference. A higher wear coefficient K is indicative of a higher resistance to wear. As such, in the present implementation, the material forming the left and right bumpers 140 has a higher wear coefficient K than the material forming the top surface 132. Other methods of determining the resistance to wear of a material could be used. Other metrics could also be used to quantify the resistance to wear of a material.

Suitable materials for forming the left and right bumpers 140 include polymeric materials, such as nylon and suitable materials for forming the engine unit housing 130 include fiber reinforced composite materials such as sheet moulding compound (SMC). Other suitable materials are contemplated for forming the bumpers 140 and the engine unit housing 130.

Figure 12:
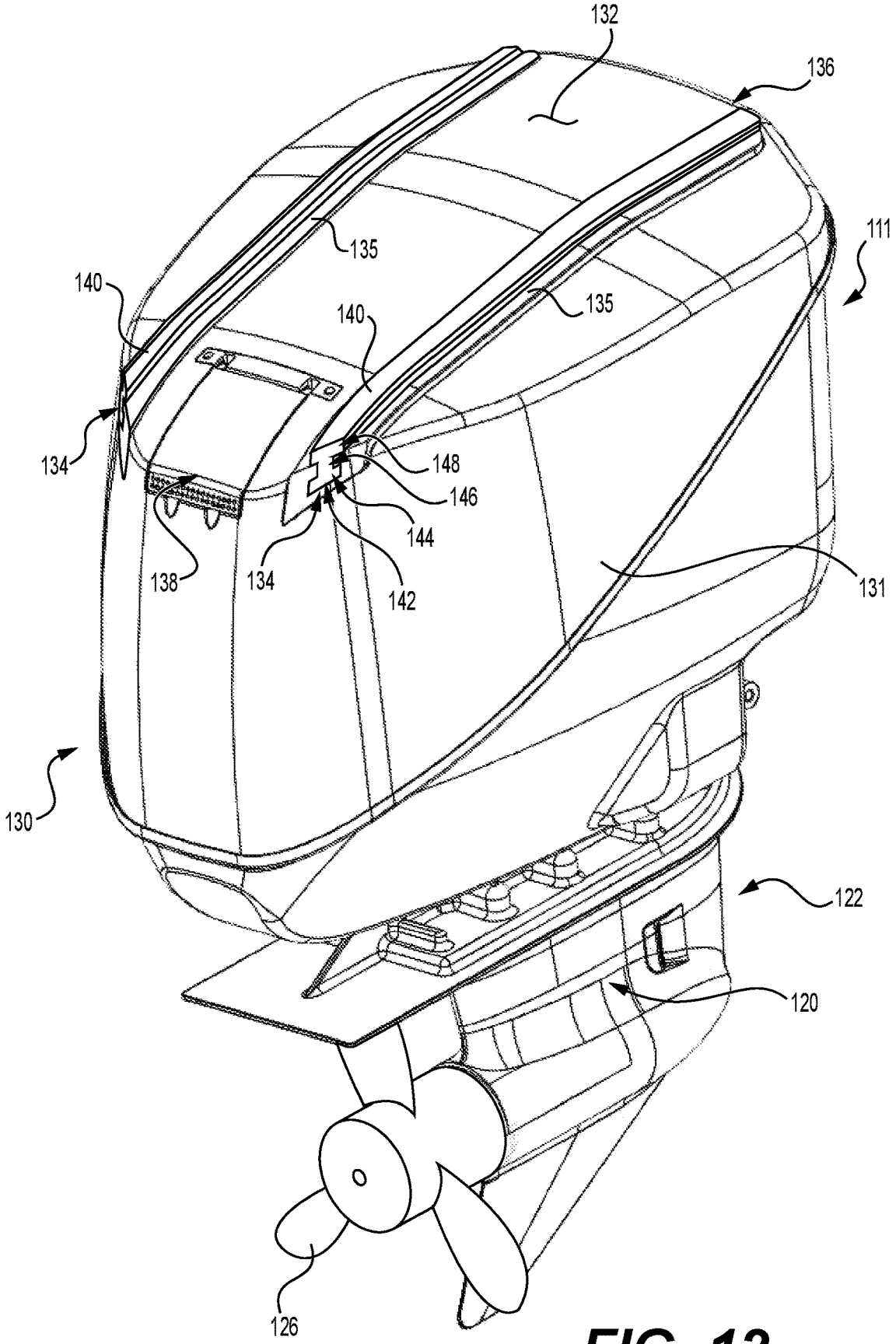
FIG. 12 is a perspective view taken from a rear, top, right side of the marine outboard engine of FIG. 10.

The left and right bumpers 140 have an I-shaped profile 142, which is best seen in FIGS. 11 and 12. The profile 142 defines a lower portion 144, a middle portion 146 and an upper portion 148 of the bumper 140. The left and right channels 134 have a complementary profile adapted to receive and retain the left and right bumpers 140 therein such that the lower portion 144 and the middle portion 146 of their profiles 142 are received within the channels 134 while the upper portion 148 of their profiles 142 extends above the channels 134. As such, the left and right bumpers 140 are only partially received within the left and right channels 134. The left and right bumpers 140 are partially received in their corresponding channel 134 by inserting them from the rear end 138 of the top surface 132 and sliding them towards the front end 136. When the left and right bumpers 140 are partially received within the left and right channels 134 as such, the left and right bumpers 140 are connected to the top surface 132 of the cover 131 of the engine unit housing 130, and the upper portion 148 of each of the left and right bumpers 140 projects above the top surface 132 of the engine unit housing 130. Moreover, the left and right bumpers 140 extend across the top surface 132 from the front end 136 to the rear end 138 of the top surface 132.

In other implementations, only one or more than two bumpers 140 could be connected to the top surface 132 of the engine unit housing 130. In addition, the bumper(s) 140 could project above the top surface 132 of the engine unit housing 130 otherwise than what is shown in the accompanying Figures. For example, in one implementation, the bumper 140 is shaped as a cylindrical protrusion projecting from the top surface 132 of the cover 131 of the engine unit housing 130. The bumper 140 thus projects from at least a portion of the top surface 132 so as to extend above the top surface 132 in a region surrounding the bumper 140. In another implementation, the bumper 140 is shaped as an ovoid hemisphere projecting from the top surface 132 of the engine unit housing 130. In other implementations, more than two bumpers 140 could be connected to the cover 131 of the engine unit housing 130. In sum, the bumpers 140 are sized and positioned to be the first part of the marine outboard engine 100 that abuts the bottom surface 44 of the hatch 40. The bumpers 140 prevent contact and rubbing between the top surface 132 of the cover 131 of the engine unit housing 130 and the bottom surface 44 of the hatch 40 when the marine outboard engine 100 makes contact with the hatch 40, as will be described below.

Referring back to FIGS. 1 to 3, the boat 10 is shown with the hatch 40 in the closed position and with the marine outboard engine 100 pivoted about the tilt-trim axis 64 in an intermediate trimmed position. As such, the marine outboard engine 100 is pivoted within at least one portion of the trim range 68. When the marine outboard engine 100 is in the trim range 68, the left and right bumpers 140 do not abut the bottom surface 44 of the hatch 40 of the rear platform 30. Thus, when the marine outboard engine 100 is pivoted through the trim range 68, there is no contact between the bumpers 140 and the bottom surface 44 of the hatch 40.

Referring to FIGS. 4 to 6, when the marine outboard engine 100 is pivoted upwardly about the tilt-trim axis 64 from the trim range 68 into the tilt range 69, the marine outboard engine 100 eventually reaches a tilt position where the bumpers 140 abut the bottom surface 44 of the hatch 40 with the hatch 40 in the closed position. This position is referred to herein as the tilt contact position. After reaching the tilt contact position, continuing to tilt up the marine outboard engine 100 causes the left and right bumpers 140 to abut and slide along the bottom surface 44 of the hatch 40, and causes the marine outboard engine 100 to push the hatch 40 upwardly from the closed position towards the intermediate open position. The intermediate open position shown in FIGS. 4 to 6 is reached when the marine outboard engine 100 is pivoted about the tilt-trim axis 64 until the fully tilted-up position is reached. It is contemplated that in some implementations, the tilt contact position could be the position of the marine outboard engine 100 as soon as it enters the tilt range 69 from the trim range 68.

Since the hatch pivot axis 52 and the tilt-trim axis 64 are not coaxial, having the left and right bumpers 140 extending across the top surface 132 of the engine unit housing 130 ensures engagement of the left and/or right bumpers 140 on the bottom surface 44 of the hatch 40 throughout the pivoting motion of the marine outboard engine 100 between the tilt contact position and the fully tilted-up position (FIGS. 4 to 6). In addition, since the bumpers 140 abut and slide along the bottom surface 44 of the hatch 40 during the pivoting of the marine outboard engine 100, the top surface 132 of the engine housing unit 130 remains spaced from the bottom surface 44 of the hatch 40. Thus, there is no rubbing or scratching of the top surface 132 of the engine unit housing 130 caused by engagement of the top surface 132 with the bottom surface 44 of the hatch 40.

Referring to FIGS. 7 to 9, when the marine outboard engine 100 has reached the fully tilted-up position, the hatch 40 can be further pivoted from the intermediate open position to the fully open position through manual operation. For example, when the hatch 40 is in the intermediate open position, a user who desires to fully open the hatch 40 lifts the hatch 40 and pivots the hatch 40 upwardly and forwardly past the vertical plane 54. When pivoted in the fully open position, the bottom surface 44 of the hatch 40 is spaced from the left and right bumpers 140. When pivoted in the fully open position, the hatch 40 grants access to the marine outboard engine 100 from above, and for example, from the rear platform 30. Thus, should the marine outboard engine 100 need to be accessed while the boat 10 is on a body of water, the hatch 40 can be pivoted to the fully open position for providing access to the marine outboard engine 100 to a user standing on the top surface 32 of the rear platform 30.

Still referring to FIGS. 7 to 9, the boat 10 further includes a lock 150 for maintaining the hatch 40 pivoted in the fully open position. The lock 150 is also used to maintain the hatch 40 pivoted in the closed position shown in FIGS. 1 to 3. In some implementations, more than one lock 150 could be used. In the present implementation, the lock 150 includes a support rod 152 schematically represented by a double arrow in FIGS. 7 to 9. The support rod 152 extends between the rear platform 30 and the hatch 40. The lock 150 is useful to maintain the hatch 40 pivoted in the fully open position when access to the marine outboard engine 100 is desired when the boat 10 is on or off the water.

In other implementations, one or more gas struts could be pivotally connected between the rear platform 30 and the hatch 40. The gas struts are structured and configured to bias the hatch 40 towards the fully open position. The gas struts could also be structured and configured to pivot the hatch 40 from the intermediate open position to the fully open position without intervention of a user. In such implementations, the hatch 40 could be pivoted from the intermediate open position to the fully open position without need for manual pivoting of the hatch 40.

An illustrative scenario describing a method of opening the hatch 40 of the rear platform 30 of the boat 10 from the closed position shown in FIGS. 1 to 3 to an open position, such as the intermediate open position shown in FIGS. 4 to 6, using the marine outboard engine 100 will now be provided.

Initially and referring to FIGS. 1 to 3, the hatch 40 is in the closed position. The rear platform 30 and the hatch 40 thus form a continuous planar surface on which one or more occupants can stand and/or reboard the boat 10 from the stern 19 thereof. The marine outboard engine 100 is pivoted within the trim range 68 and can be used for propulsion and steering of the boat 10.

When a user operates the tilt-trim actuator 74 to pivot the marine outboard engine 100 upwardly about the tilt-trim axis 64 from the trim range 68 to the tilt contact position in the tilt range 69, the left and right bumpers 140 projecting above the top surface 132 of the engine unit housing 130 abut the bottom surface 44 of the hatch 40. Upon further upward pivoting of the marine outboard engine 100 within the tilt range 69, the left and right bumpers 140 remain in abutment with the bottom surface 44 of the hatch 40, causing the left and right bumpers 140 to push against the bottom surface 44 of the hatch 40 and to slide along the bottom surface 44 of the hatch 40, thereby pivoting the hatch 40 from the closed position (seen in FIGS. 1 to 3) to the intermediate open position (seen in FIGS. 4 to 6). When in the intermediate open position, the user can pivot the marine outboard engine 100 downwardly through the tilt range 69, causing the hatch 40 to be pivoted from the intermediate open position back to the closed position once the marine outboard engine 100 reaches the tilt contact position.

If desired and when the hatch 40 is pivoted in the intermediate open position, the user can further pivot the hatch 40 about the hatch pivot axis 52 from the intermediate open position to the fully open position (seen in FIGS. 7 to 9) through manual operation, as described above. When in the fully open position, the user can lock the hatch 40 pivoted in the fully open position using the lock 150.

Conversely, when a user desires to pivot the hatch 40 from the fully open position to the closed position and with the marine outboard engine 100 pivoted in the tilt range 69, the user first disengages the lock 150 and pivots the hatch 40 manually from the fully open position until the bottom surface 44 of the hatch 40 abuts the left and right bumpers 140 provided on the top surface 132 of the engine unit housing 130. The user then operates the tilt-trim actuator 74 to pivot the marine outboard engine 100 downwardly about the tilt-trim axis 64, the hatch 40 remaining in abutment with the left and right bumpers 140 when the marine outboard engine 100 is pivoted in the tilt range 69 until the marine outboard engine 100 reaches the tilt contact position and the bottom surface 44 of the hatch 40 abuts the lip portions 39 of the rear platform 30 and reaches the closed position. The lock 150 is re-engaged to lock the hatch 40 in the closed position. The marine outboard engine 100 can be pivoted further down in the trim range 68 for submerging the propeller 126 in the water and propel and steer the boat 10. Alternatively, the user can first operate the tilt-trim actuator 74 to pivot the marine outboard engine 100 into the tilt range 69 and subsequently lower the hatch 40 from the fully open position to the closed position.

Figure 15:
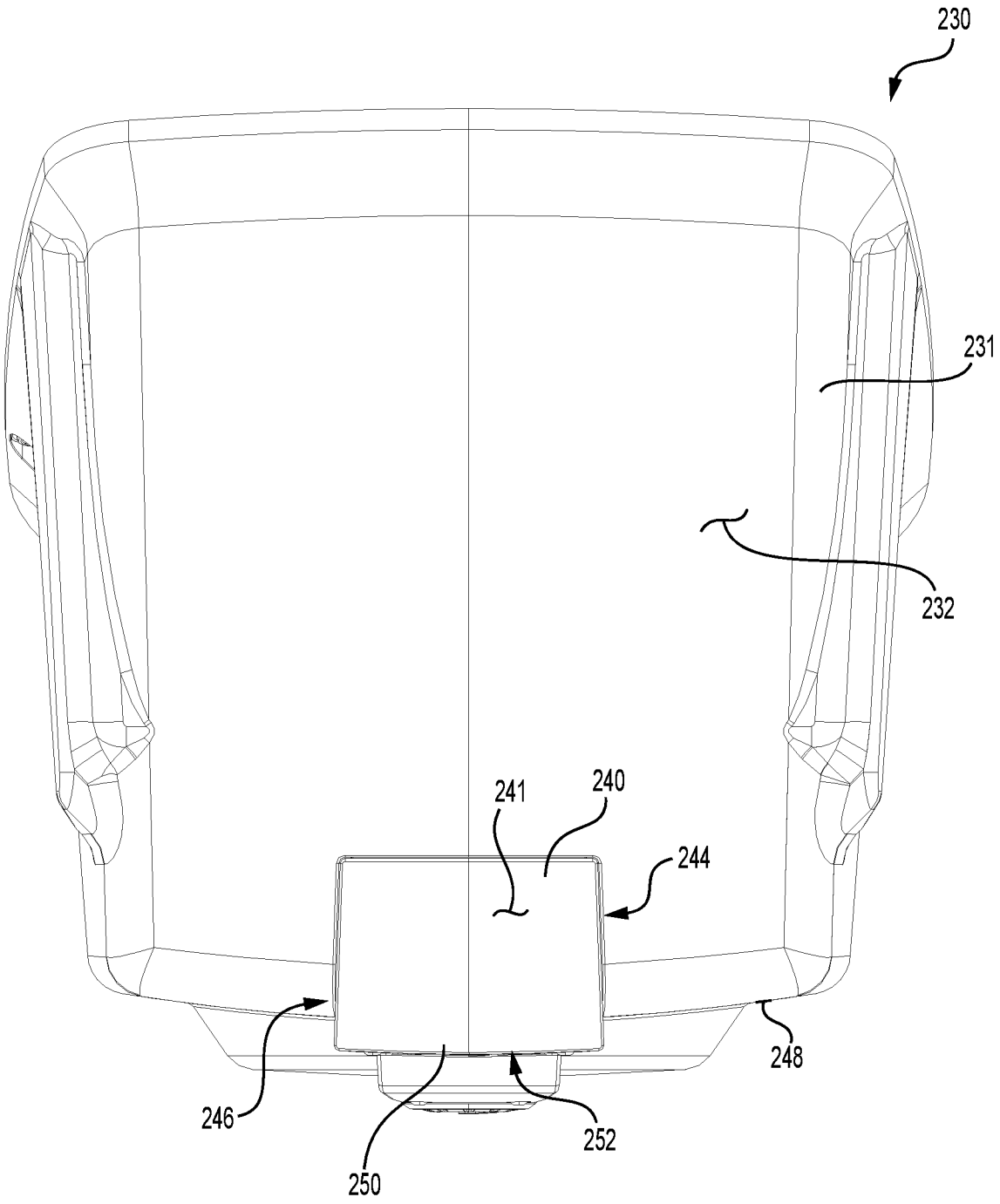
FIG. 15 is a top plan view of the cover of FIG. 14.
Figure 16:
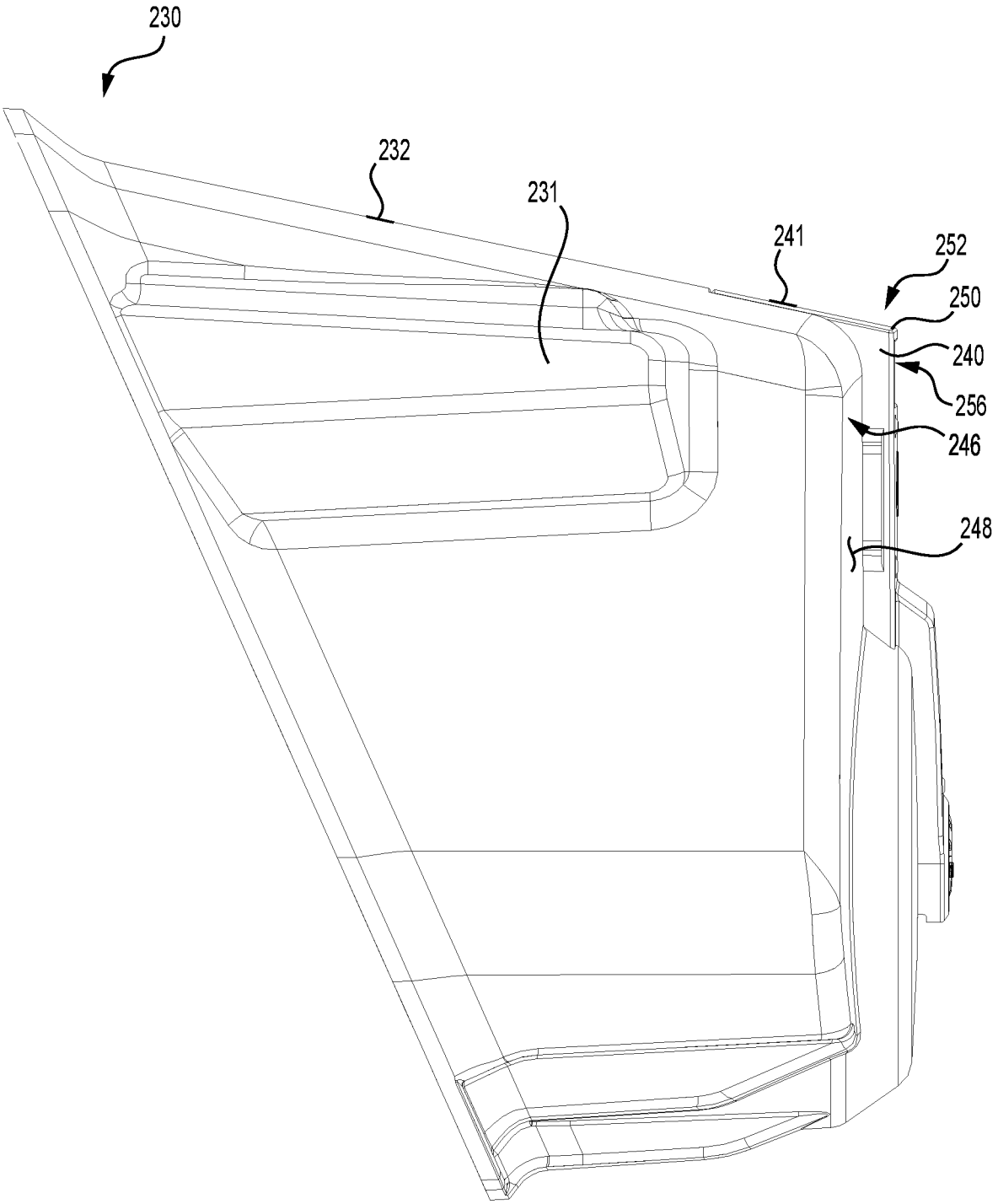
FIG. 16 is left side elevation view of the cover of FIG. 14.
Figure 17:
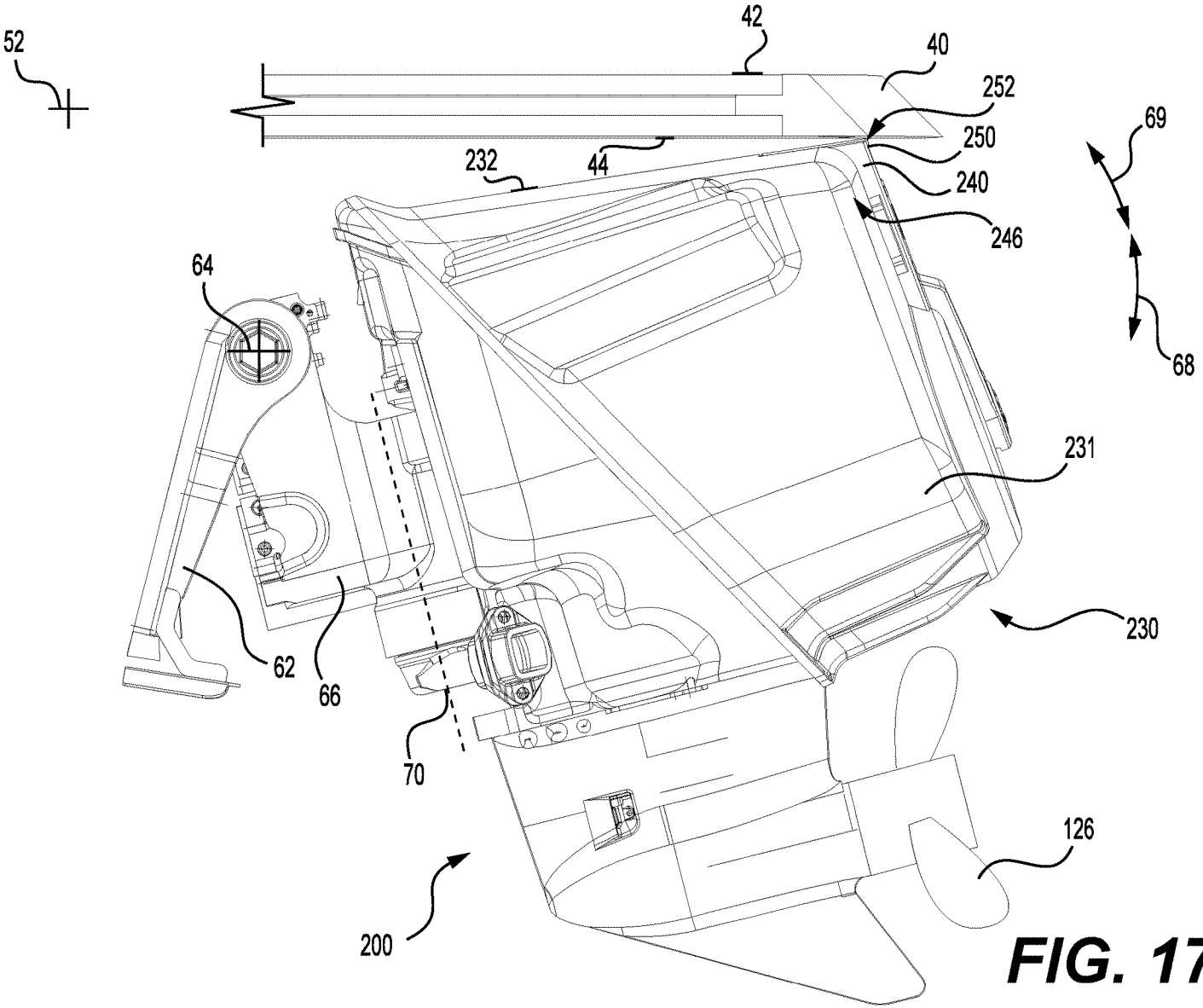
FIG. 17 is a left side elevation view of a marine outboard engine having the cover of FIG. 14 pivoted about a tilt-trim pivot axis in a trimmed position, and with a hatch of a rear platform pivoted in a closed position.
Figure 18:
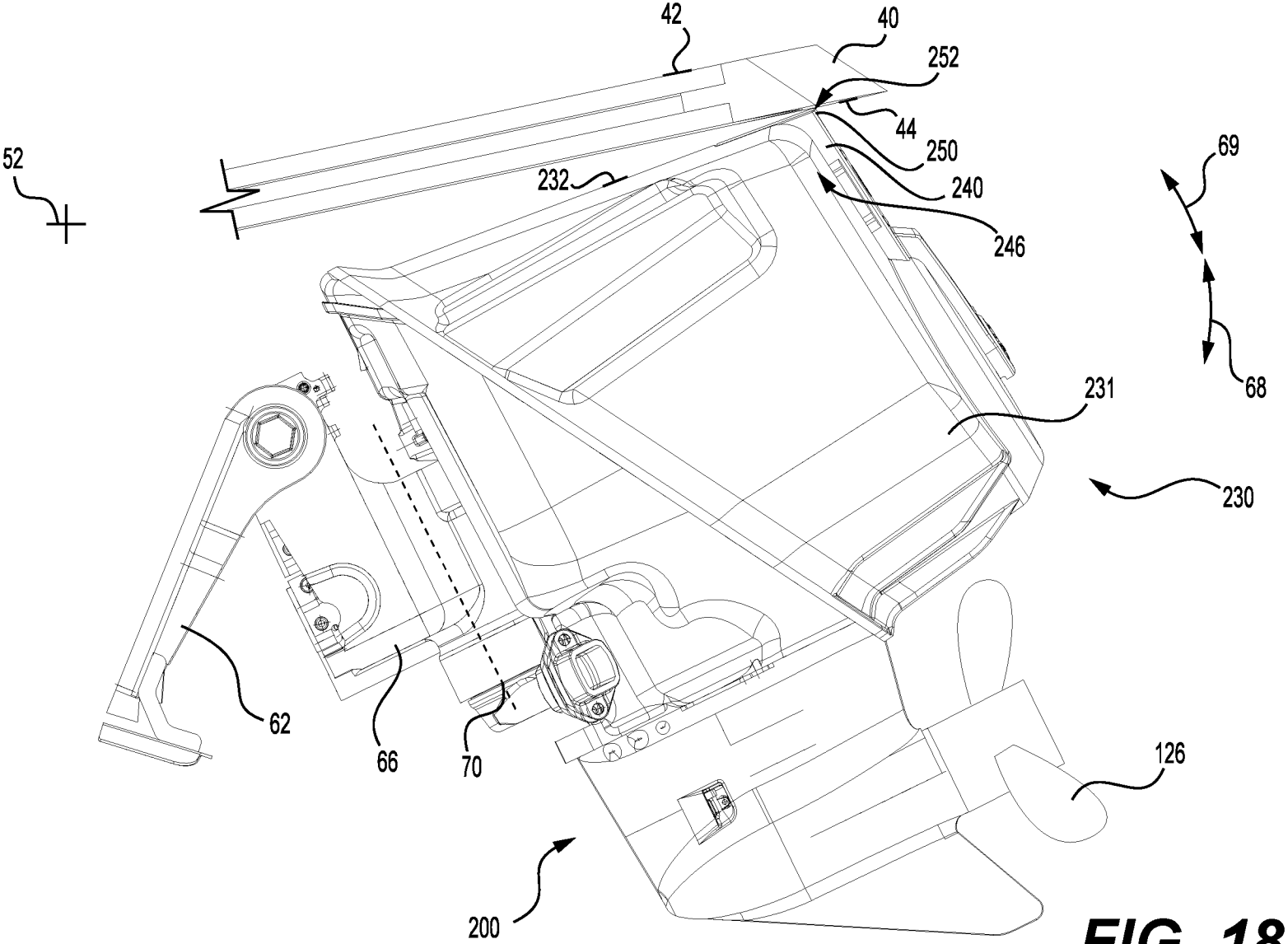
FIG. 18 is a left side elevation view of the marine outboard engine of FIG. 17 pivoted about the tilt-trim axis in a fully tilted-up position and with the hatch pivoted in an intermediate open position.

Referring now to FIGS. 14 to 18, there is shown a cover 231 of an engine unit housing 230 of a marine outboard engine 200 (shown in FIGS. 17 and 18). The marine outboard engine 200 has components including elements that are the same as or similar to those described with reference to the marine outboard engine 100. Therefore, for simplicity, elements of the marine outboard engine 200 that are the same as or similar to those of the marine outboard engine 100 have been labeled with the same reference numerals, and will not be described again in detail.

Figure 14:
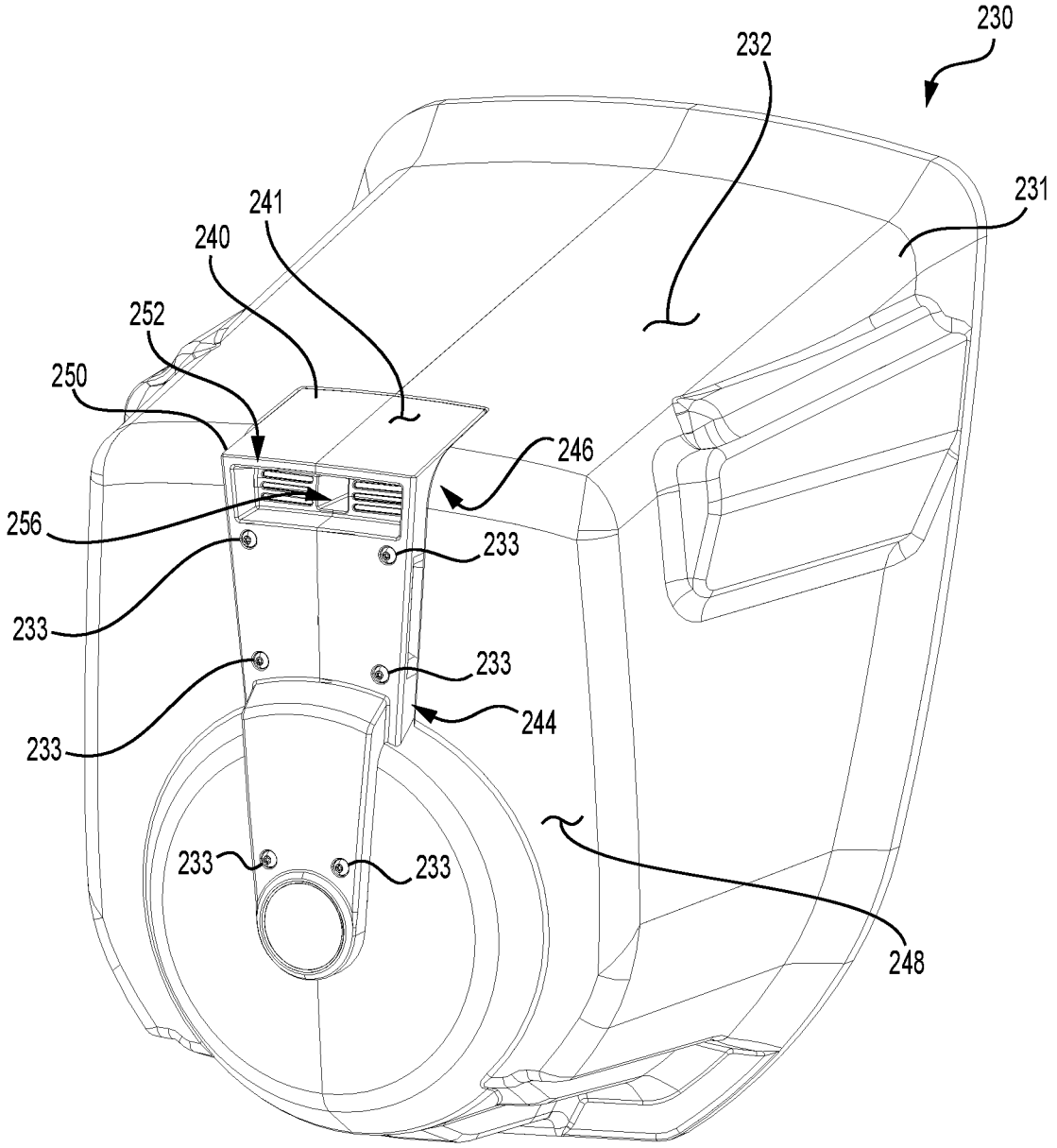
FIG. 14 is a perspective view taken from a rear, top, right side of a cover of another implementation of an engine unit housing for a marine outboard engine.

Referring to FIGS. 14 to 16, the cover 231 of the engine unit housing 230 has a top surface 232. A bumper 240 is connected to the cover 231 of the engine unit housing 230 using six fasteners 233. The bumper 240 is partially received in a recess 244 defined in the cover 231.

As best seen in FIG. 16, a top face 241 of the bumper 240 is coplanar with the top surface 232 of the cover 231. The bumper 240 projects rearward of an upper rear end 246 of the cover 231 of the engine unit housing 230. The upper rear end 246 corresponds to a portion of the engine unit housing 230 that extends vertically from the top surface 232 of the cover 231 and along a rear face 248 of the cover 231 down to about one third of the height of the cover 231. In the present implementation, the bumper 240 extends vertically down to the portion of the cover 231 covering the flywheel of the engine 112, but the bumper 240 could be vertically shorter in other implementations.

Furthermore, the bumper 240 has an upper rear edge 250 defining an upper rear edge 252 of the engine unit housing 230. An aperture 256 (FIG. 14) is defined in the rear face of the bumper 240. In some implementations, the aperture 256 defines an idle relief exhaust outlet and/or a cooling water outlet of the marine outboard engine 200.

Like the bumpers 140 described above, the bumper 240 is made of a material that differs from the material forming the top surface 232 of the cover 231 of the engine unit housing 230. In the present implementation, the bumper 240 is made of polymeric material, such as nylon. The cover 231 of the engine unit housing 230 is made of fiber reinforced composite materials such as sheet moulding compound (SMC). The material of the bumper 240 is more resistant to wear than the material forming the top surface 232 of the cover 231 engine unit housing 230.

In FIG. 17, the marine outboard engine 200 is shown pivoted about the tilt-trim axis 64 to the tilt contact position in the tilt range 69, and the upper rear edge 250 of the bumper 240, and thus the upper rear edge 252 of the engine unit housing 230, is the first part of the marine outboard engine 200 that abuts the bottom surface 44 of the hatch 40. More particularly, when the upper rear edge 250 of the bumper 240 abuts the bottom surface 44 of the hatch 40, the top surface 232 of the cover 231 of the engine unit housing 230 remains spaced from the bottom surface 44 of the hatch 40.

In FIG. 18, the marine outboard engine 200 is shown pivoted further upwardly about the tilt-trim axis 64 within the tilt range 69, and the upper rear edge 250 of the bumper 240 remains in abutment with the bottom surface 44 of the hatch 40, causing the bumper 240 to push against the bottom surface 44 of the hatch 40 and to slide along the bottom surface 44 of the hatch 40, thereby pivoting the hatch 40 from the closed position (seen in FIG. 17) to the intermediate open position (seen in FIG. 18). The top surface 232 of the cover 231 of the engine unit housing 230 remains spaced from the bottom surface 44 of the hatch 40 during the pivoting of the marine outboard engine about the tilt-trim axis 64 within the tilt range 69.

When in the intermediate open position, the user can pivot the marine outboard engine 200 downwardly through the tilt range 69, causing the hatch 40 to be pivoted from the intermediate open position back to the closed position once the marine outboard engine 100 reaches the tilt contact position (FIG. 17).

In the marine outboard engine 100 described with reference to FIGS. 10 to 12, the bumpers 140 are sized and structured to project above the top surface 132 of the cover 131 of the engine unit housing 130. In the marine outboard engine 200, the bumper 240 is sized and structured to extend rearward of the upper rear end 246 of the cover 231 of the engine unit housing 230. It is contemplated that the bumper 240 could be sized and structured otherwise in other implementations.

Figure 19:
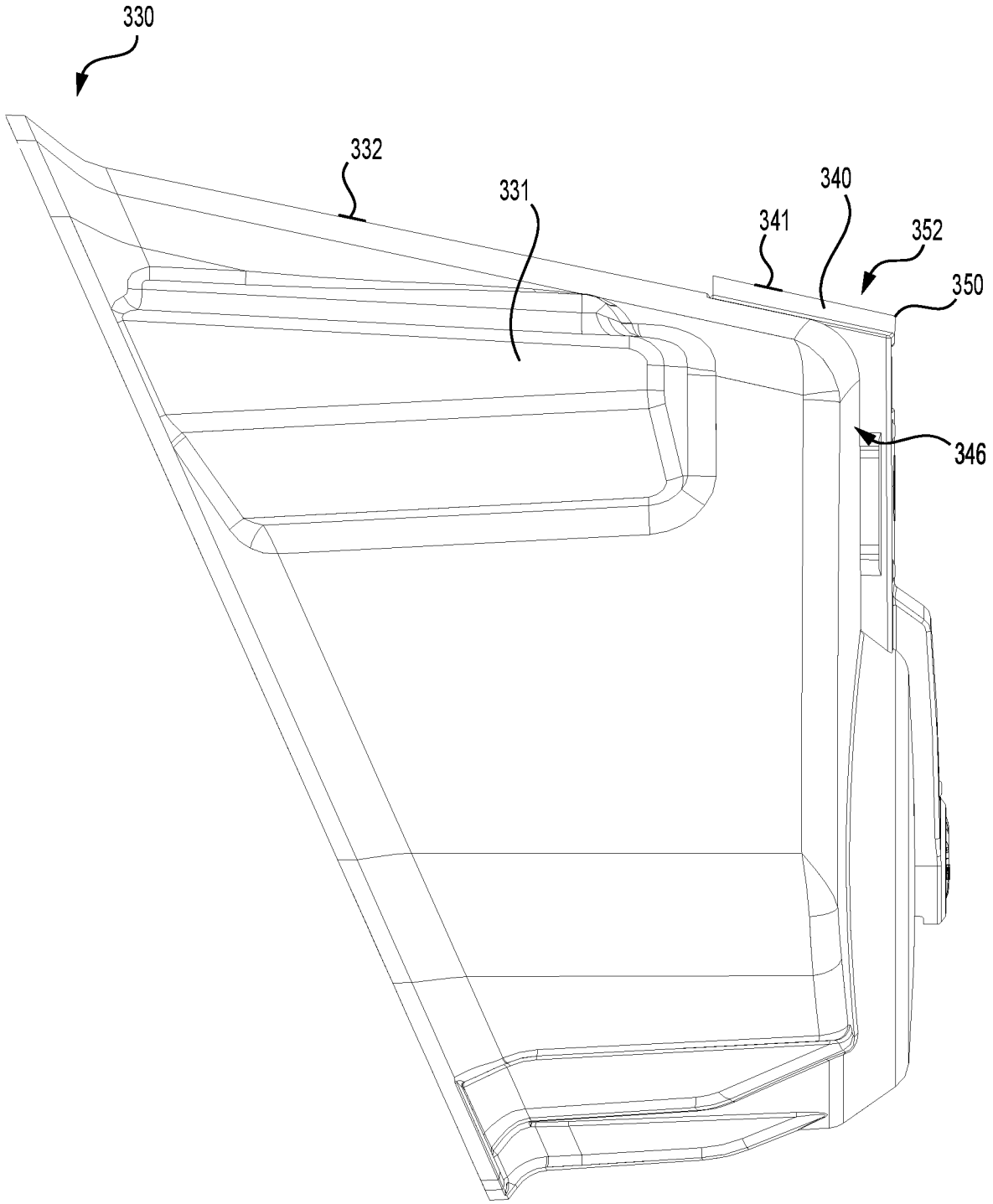
FIG. 19 is a left side elevation view of a cover of yet another implementation of an engine unit housing for a marine outboard engine.

For example and referring to FIG. 19, there is shown another implementation of a cover 331 for an engine unit housing 330 having a bumper 340 similar to the bumper 240, but the bumper 340 additionally projects above a top surface 332 of the cover 331 of the engine unit housing 330. More particularly, a top surface 341 of the bumper 340 is vertically higher than the region of the top surface 332 locally surrounding the bumper 340. The bumper 340 further has an upper rear edge 350 defining an upper rear edge 352 of the engine unit housing 330. The upper rear edge 350 extends both vertically higher than the region of the top surface 332 locally surrounding the bumper 340, and rearward of an upper rear end 346 of the cover 331 of the engine unit housing 330.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A marine outboard engine, comprising:
- an engine unit;
- a drive unit operatively connected to the engine unit;
- an engine unit housing for supporting and covering the engine unit, the engine unit housing having a top surface; and
- at least one bumper connected to the engine unit housing, the at least one bumper projecting:
  - above the top surface of the engine unit housing; or
  - rearward of an upper rear end of the engine unit housing; or
  - both above the top surface of the engine unit housing and rearward of an upper rear end of the engine unit housing,
- when the marine outboard engine is located under a hatch of a boat being in a closed position and the marine outboard engine is pivoted in at least one portion of a tilt range:
- the at least one bumper being adapted for abutting a bottom surface of the hatch.

2. The marine outboard engine of claim 1, wherein the at least one bumper projects rearward of the upper rear end of the engine unit housing.

3. The marine outboard engine of claim 1, wherein the at least one bumper projects above the top surface of the engine unit housing.

4. The marine outboard engine of claim 1, wherein the top surface of the engine unit housing is formed from a first material and the at least one bumper is made of a second material that is different from the first material.

5. The marine outboard engine of claim 4, wherein the second material is more resistant to wear than the first material.

6. The marine outboard engine of claim 3, wherein the at least one bumper extends across the top surface of the engine unit housing from a front end to a rear end of the top surface.

7. The marine outboard engine of claim 3, further comprising at least one channel defined in the top surface of the engine unit housing, the at least one bumper being received at least in part within the at least one channel.

8. The marine outboard engine of claim 1, wherein the at least one bumper includes a first bumper and a second bumper.

9. The marine outboard engine of claim 1, wherein the engine unit includes an engine block and the drive unit includes a gear case, and the engine block is disposed above the gear case and in proximity to the gear case.

10. A marine outboard engine, comprising:
- an engine unit;
- a drive unit operatively connected to the engine unit;
- an engine unit housing for supporting and covering the engine unit, the engine unit housing having a top surface;
- at least one bumper connected to the engine unit housing, the at least one bumper projecting above the top surface of the engine unit housing; and
- at least one channel defined in the top surface of the engine unit housing, the at least one bumper being received at least in part within the at least one channel.

11. The marine outboard engine of claim 10, wherein the at least one bumper includes a first bumper and a second bumper.

12. The marine outboard engine of claim 10, wherein the engine unit includes an engine block and the drive unit includes a gear case, and the engine block is disposed above the gear case and in proximity to the gear case.

13. The marine outboard engine of claim 10, wherein the top surface of the engine unit housing is formed from a first material and the at least one bumper is made of a second material that is different from the first material.

14. The marine outboard engine of claim 13, wherein the second material is more resistant to wear than the first material.

* * * * *